US007054129B2

(12) United States Patent
Aida et al.

(10) Patent No.: US 7,054,129 B2
(45) Date of Patent: May 30, 2006

(54) STATIC ELECTRICITY ELIMINATING APPARATUS AND STATIC ELECTRICITY ELIMINATING METHOD

(75) Inventors: Kazuyoshi Aida, Kokubu (JP); Hitoshi Arai, Kiryu (JP)

(73) Assignees: IMT Company, Ltd., Kagoshima (JP); Hitoshi Arai, Gunma (JP)

( * ) Notice: Subject to any disclaimer, the term of this patent is extended or adjusted under 35 U.S.C. 154(b) by 338 days.

(21) Appl. No.: 10/754,715

(22) Filed: Jan. 12, 2004

(65) Prior Publication Data

US 2004/0174654 A1 Sep. 9, 2004

(30) Foreign Application Priority Data

Mar. 3, 2003 (JP) ..... 2003-055277
Sep. 25, 2003 (JP) ..... 2003-332859

(51) Int. Cl.
*H01H 47/00* (2006.01)

(52) U.S. Cl. ..... 361/220

(58) Field of Classification Search ..... 361/56–58, 361/111, 118, 120, 220, 221
See application file for complete search history.

(56) References Cited

U.S. PATENT DOCUMENTS 5,392,188 A * 2/1995 Epstein ..... 361/118

FOREIGN PATENT DOCUMENTS

| | | |
|---|---|---|
| JP | 01-251598 | 10/1989 |
| JP | 5-174376 | 7/1993 |
| JP | 10-316321 | 12/1998 |
| JP | 2000-262303 | 9/2000 |
| JP | 2001-035684 | 2/2001 |

* cited by examiner

*Primary Examiner*—Adolf Deneke Berhane
*Assistant Examiner*—Robert T. Dang
(74) *Attorney, Agent, or Firm*—Wenderoth, Lind & Ponack, L.L.P.

(57) ABSTRACT

A static electricity eliminating apparatus comprising; (A) a first electrically conductive piece and a second electrically conductive piece which are disposed so as to face each other through an insulating layer, and (B) a discharge means having one end electrically connected to the first electrically conductive piece and other end electrically connected to the second electrically conductive piece, wherein a charge electrostatically induced in the first electrically conductive piece and the second electrically conductive piece due to a contact of a static-electricity-charged object with the first electrically conductive piece is accumulated between the first electrically conductive piece and the second electrically conductive piece by dielectric polarization, and then, the charge is discharged with the discharge means in a state where the first electrically conductive piece and the second electrically conductive piece are not grounded.

16 Claims, 11 Drawing Sheets

STATIC ELECTRICITY ELIMINATING APPARATUS AND STATIC ELECTRICITY ELIMINATING METHOD

BACKGROUND OF THE INVENTION AND RELATED ART STATEMENT

The present invention relates to a static electricity eliminating apparatus and a static electricity eliminating method.

In daily life, for example, when one walks, static electricity occurs due to a friction between the person and his or her clothes. Further, most of floors, halls, lobbies and the like are covered with carpets, and when one walks on the carpet, static electricity occurs on his or her body. The static electricity is accumulated on a human body or the clothes as a static charge without being naturally discharged. As a result, when one touches a door to a room, a door to a house, a doorknob, up-down buttons of an elevator, a doorknob of an automobile, metallic furniture or the like, a charge (static electricity) charged in a human body and/or the clothes is rapidly discharged to cause an impact on the human body.

Further, electronic machines and tools such as personal computers and cellular phones use a number of integrated circuits and electronic parts. When one charged with static electricity comes close to the electronic machine or tool or touches it, electrostatic induction of a charge takes place in the electronic machine or tool in many cases. When a charge accumulated in the electronic machine or tool is discharged at once to be over the withstand voltage of the electronic part constituting the electronic machine or tool, a discharge voltage is sometimes over several kilovolts, so that such a high discharge voltage causes the electronic machine or tool to operate in error or to have a trouble.

As a method of alleviating an impact on a human body when a charge (static electricity) is discharged, generally, there is a method in which provided is a static electricity eliminating apparatus grounded (earthed) through a high-resistance circuit (more specifically, for example, a so-called surge-absorbing circuit including a resistor), and one touches the static electricity eliminating apparatus to flow the charge (static electricity) to the ground.

Concerning an electronic machine and tool, there can be a method in which a static electricity eliminating circuit comprising a combination of a coil or a resistor for suppressing a discharge current and a condenser or Zener diode for absorbing an electrostatic pulse is incorporated into the electronic machine or tool. For eliminating static electricity in a product charged, for example, by a friction during transportation (for example, a charged film or a charged electronic part), there is known a method using a static electricity eliminator according to an AC voltage applying method that generates ion gases for ionizing an atmosphere in the vicinity of the charged product by corona discharge.

JP-A-10-316321 (for example, in FIGS. 1 and 2 on page 3) discloses a constitution of an elevator hall touch panel, in which a static electricity absorbing plate is grounded through a high-resistance resistor. It is said that according to the technique disclosed in the above JP-A-10-316321, the voltage of static electricity is exerted on the resistor not instantly but over a long period of time as compared with the case where the resistor is not present, so that an impact on a human body can be alleviated.

JP-A-2001-35684 (for example, on page 2) discloses a method in which a metallic portion of a structure or a door of an automobile is grounded through a contact member. A so-called surge-absorbing circuit including a resistor is incorporated into a circuit to which static electricity is discharged, for easing an abrupt discharge.

JP-A-01-251598 (for example, on page 2) discloses a technique of allowing an electrically conductive substance to adhere to an electrically conductive fiber for removing static electricity without grounding.

JP-A-05-174376 (for example, on pages 2 and 4 and FIG. 1) discloses a method in which static electricity charged on a polyethylene terephthalate film (PET film) is neutralized by means of an ion-generating apparatus for applying a high voltage to an ion-generating electrode from a high voltage power source to ionize air.

JP-A-2000-262303 (for example, on page 1) discloses a product called a "wrist trap" as one measure to be taken against static electricity in a factory.

However, in a static electricity eliminating method using a conventional static electricity eliminating apparatus having a high-resistance resistor or an electrically conductive material intervened in a path through which a charge (static electricity) charged in clothes is discharged for easing an abrupt discharge, a discharge circuit is formed on condition that the discharge circuit is grounded, and a human body is part constituting the discharge circuit, so that a considerable impact is exerted on some persons during discharging. In the above method, inconveniently, one is required to touch the static electricity eliminating apparatus that is constantly grounded. Further, the charged state greatly differs depending upon persons, some persons are charged with static electricity a little, and some persons are charged greatly. With a static electricity eliminating method (grounding method) using a conventional static electricity eliminating apparatus, there are some cases where a person charged greatly cannot avoid an impact.

The method of incorporating a static electricity eliminating circuit into an electronic machine or tool involves a problem that it is required to constantly ground the static electricity eliminating circuit. Further, when an electronic machine or tool is grounded, it sometimes picks up a noise from the ground, so that a trouble may be caused on the operation of the electronic machine or tool. Cellular phones are widely spreading in recent years. However, it is difficult to ground a cellular phone due to its properties, and there are some troubles on the cellular phones that are considered to occur due to static electricity charged in a human body. The static electricity eliminator according to an AC voltage applying method, which is used in a method in which static electricity in a charged product is eliminated by ionizing an atmosphere in the vicinity of the charged product by corona discharge, is expensive, and it requires electric power supply for generating ion gases.

The technique disclosed in JP-A-10-316321 has a problem that a leak of electricity is dangerous and also has a problem that it is difficult to determine whether static electricity is reliably eliminated or not because a static-electricity-eliminated state is not notified.

In the technique disclosed in JP-A-2001-35684, some persons suffer an impact, and, inconveniently, it is required to seek for a metallic portion of a structure, a door of an automobile or the like with which the contact member is to be brought in contact.

In the technique disclosed in JP-A-01-251598, there is involved a problem that an explosion or ignition is liable to be caused when an ignitable gas or organic solvent is present in the vicinity of a place where static electricity is to be eliminated, since static electricity is eliminated by air discharge. The place for use thereof is therefore limited.

The technique disclosed in JP-A-05-174376 requires an expensive ion generating apparatus and requires electric power for generating an ion.

In the technique disclosed in JP-A-2000-262303, it is required to ground the wrist trap, and a wiring (code) is provided for the grounding, which is inconvenient for working.

OBJECT AND SUMMARY OF THE INVENTION

It is therefore an object of the present invention to provide a static electricity eliminating apparatus that overcomes the defects of the prior arts, which can be used in broad fields and which has a simple structure, and a static electricity eliminating method using the above static electricity eliminating apparatus.

A static electricity eliminating apparatus of the present invention for achieving the above object comprises;

(A) a first electrically conductive piece and a second electrically conductive piece which are disposed so as to face each other through an insulating layer, and (B) a discharge means having one end electrically connected to the first electrically conductive piece and other end electrically connected to the second electrically conductive piece, wherein a charge electrostatically induced in the first electrically conductive piece and the second electrically conductive piece due to a contact of a static-electricity-charged object with the first electrically conductive piece is accumulated between the first electrically conductive piece and the second electrically conductive piece by dielectric polarization, and then, the charge is discharged with the discharge means in a state where the first electrically conductive piece and the second electrically conductive piece are not grounded.

The static electricity eliminating method of the present invention for achieving the above object is a static electricity eliminating method with a static electricity eliminating apparatus comprising;

(A) a first electrically conductive piece and a second electrically conductive piece which are disposed so as to face each other through an insulating layer, and (B) a discharge means having one end electrically connected to the first electrically conductive piece and other end electrically connected to the second electrically conductive piece, said method comprising;

accumulating a charge, which is electrostatically induced in the first electrically conductive piece and the second electrically conductive piece due to a contact of a static-electricity-charged object with the first electrically conductive piece, between the first electrically conductive piece and the second electrically conductive piece by dielectric polarization, and then, discharging the charge with the discharge means in a state where the first electrically conductive piece and the second electrically conductive piece are not grounded.

In the static electricity eliminating apparatus or the static electricity eliminating method of the present invention (these will be sometimes generally and simply referred to as "the present invention" hereinafter), the term "contact" not only includes an embodiment in which the static-electricity-charged object touches, or comes in contact with, the first electrically conductive piece directly, or an embodiment of touching or contacting the first electrically conductive piece with the static-electricity-charged object directly, but also includes an embodiment in which the static-electricity-charged object touches, or comes in contact with, the first electrically conductive piece indirectly, or an embodiment of touching or contacting the first electrically conductive piece with the static-electricity-charged object indirectly. The above embodiment of the "indirect contact" or "indirect touch" includes, for example, a state where the static-electricity-charged object and the first electrically conductive piece are electrically connected to each other through a wiring. After the charge is discharged with the discharge means (or with the second discharge means to be described later), the potential difference between the first electrically conductive piece and the second electrically conductive piece may be 0 volt or may have a value over 0 volt. The essence is that the potential difference can be any potential difference so long as the potential difference does not exert an impact on a human body (for example, approximately 500 volts or lower).

In the present invention, the electrostatically induced charge is discharged with the discharge means (or with the second discharge means to be described later), and the concept of "discharge" includes a concept that energy based on the charge is converted to heat with the discharge means (or with the second discharge means to be described later) and a concept that the charge is converted to light with the discharge means. When the potential difference between two ends of the above discharge means (or the second discharge means to be described later), caused by the charge accumulated between the first electrically conductive piece and the second electrically conductive piece by dielectric polarization, exceeds the discharge start voltage (break-down voltage) of the discharge means (or a second discharge means to be described later), the above charge is discharged with the discharge means (or the second discharge means). The "electrostatically induced (or electrostatic induction)" refers to a phenomenon in which when a no-electricity-charged matter is placed in the vicinity of a static-electricity-charged object such as a human body or matter that is electrically charged, polarization takes place in a material constituting the matter and the matter comes to be electrically charged.

In the present invention, preferably, the discharge means is constituted of at least one device selected from the group consisting of a varistor, a discharge tube and an air gap. The above constitution will be sometimes referred to as "the first aspect of the present invention" for convenience. Specifically, in the first aspect of the present invention, for example, the discharge means can be constituted of a varistor, constituted of a discharge tube, constituted of an air gap, constituted of a combination of a varistor and a discharge tube connected in series, or constituted of a combination of a varistor and an air gap connected in series. When the discharge tube is used as an component for the discharge means, preferably, it is preferred to employ a constitution or structure in which the discharge state of the discharge tube can be visually confirmed from an outside of the static electricity eliminating apparatus. The discharge tube or air gap sometimes makes a noise, so that it is preferred to use the varistor as a discharge means when it is necessary to avoid the noise.

In the present invention, there may be employed a constitution in which the static electricity eliminating apparatus further has a resistor connected to the discharge means in series, an analyzing means for analyzing a voltage between the two ends of the resistor and a display means for displaying an analysis result, whereby the discharge state can be easily and reliably confirmed.

In the present invention including the first aspect of the present invention, there can be employed a constitution in which the first electrically conductive piece is formed of a hollow first pipe and the second electrically conductive piece is formed of a second pipe or a rod-shaped material arranged inside the first electrically conductive piece and fixed to the first electrically conductive piece with the insulating layer. When the above constitution is employed, for example, there can be obtained a small-sized and light-weighted portable static electricity eliminating apparatus. The discharge means may be disposed in a space existing between the first electrically conductive piece and the second electrically conductive piece, or it may be disposed outside the first electrically conductive piece. When the-second electrically conductive piece is formed of a hollow pipe, the discharge means may be disposed in an internal space of the second electrically conductive piece.

The present invention including the first aspect of the present invention can have a constitution in which the insulating layer is formed of a flat plate material, the first electrically conductive piece is disposed on one surface of the insulating layer, and the second electrically conductive piece is disposed on the other surface of the insulating layer. In this case, there can be employed a constitution in which a through-hole portion is formed through the insulating layer, and the discharge means is arranged in the through-hole portion. When the above constitution is employed, there can be also obtained a small-sized and light-weighted portable static electricity eliminating apparatus.

Alternatively, the present invention including the first aspect of the present invention can have a constitution in which the first electrically conductive piece is disposed on one surface of the insulating layer, the second electrically conductive piece is disposed on the other surface of the insulating layer, a through-hole portion is formed through the insulating layer, the discharge means is disposed on the other surface side of the insulating layer, and one end of the discharge means is electrically connected to the first electrically conductive piece through the through-hole portion. When the above constitution is employed, there can be also obtained a small-sized and light-weighted portable static electricity eliminating apparatus.

Alternatively, the present invention can have a constitution in which the static electricity eliminating apparatus further has a second discharge means having one end electrically connected to the first electrically conductive piece and the other end electrically connected to the second electrically conductive piece, wherein a charge electrostatically induced in the first electrically conductive piece and the second electrically conductive piece due to a contact of a static-electricity-charged object with the first electrically conductive piece is accumulated between the first electrically conductive piece and the second electrically conductive piece by dielectric polarization, and then, the charge is discharged with the discharge means and the second discharge means in a state where the first electrically conductive piece and the second electrically conductive piece are not grounded. The above constitution will be sometimes referred to as "second aspect of the present invention" for convenience.

In the second aspect of the present invention, there may be employed a constitution in which the static electricity eliminating apparatus further has a resistor connected to the discharge means or the second discharge means in series, an analyzing means for analyzing a voltage between the two ends of the resistor and a display means for displaying an analysis result, whereby the discharge state can be easily and reliably confirmed.

In the second aspect of the present invention, there can be employed a constitution in which the discharge means is constituted of a first varistor, the second discharge means is constituted of a second varistor and a discharge tube connected in series, and the discharge start voltage (break-down voltage) of the second discharge means is lower than the discharge start voltage (break-down voltage) of the discharge means. Specifically, it is preferred to select the first varistor, the second varistor and the discharge tube such that the value obtained by adding the discharge start voltage of the second varistor to the discharge start voltage of the discharge tube is lower than the value of the discharge start voltage of the first varistor, for reliably lightening the discharge tube. When the above constitution is employed, the voltage remaining in the static electricity eliminating apparatus after discharge can be lower than the counterpart in the first aspect of the present invention. Further, since the discharge tube is provided, the discharge state can be confirmed.

In the second aspect of the present invention including the above constitution, there can be employed a constitution in which the first electrically conductive piece is formed of a hollow first pipe and the second electrically conductive piece is formed of a second pipe or rod-shaped material arranged inside the first electrically conductive piece and fixed to the first electrically conductive piece with the insulating layer. The discharge means may be disposed in a space existing between the first electrically conductive piece and the second electrically conductive piece or may be disposed outside the first electrically conductive piece. When the second electrically conductive piece is formed of a hollow pipe, the discharge means may be disposed in an internal space of the second electrically conductive piece. Further, the second discharge means may be also disposed in a space existing between the first electrically conductive piece and the second electrically conductive piece, or may be disposed outside the first electrically conductive piece. When the second electrically conductive piece is formed of a hollow pipe, the second discharge means may be disposed in an internal space of the second electrically conductive piece. When the second discharge means is disposed in a space existing between the first electrically conductive piece and the second electrically conductive piece, preferably, the first electrically conductive piece is provided with a window portion for observing the light emission state of the discharge tube constituting the second discharge means. When the second discharge means is disposed in a space inside the second electrically conductive piece, preferably, the first electrically conductive piece and the second electrically conductive piece are provided with window portions for observing the light emission state of the discharge tube constituting the second discharge means. When the above constitution is employed, there can be obtained a small-sized and light-weighted portable static electricity eliminating apparatus.

Alternatively, in the second aspect of the present invention including the above constitution, there can be employed a constitution in which the insulating layer is formed of a flat plate material, the first electrically conductive piece is disposed on one surface of the insulating layer, and the second electrically conductive piece is disposed on the other surface of the insulating layer. In this case, there can be employed a constitution in which a through-hole portion is formed through the insulating layer and the discharge means and the second discharge means are arranged in the through-hole portion. When the above constitution is employed, there can be obtained a small-sized and light-weighted portable static electricity eliminating apparatus.

Alternatively, in the second aspect of the present invention including the above constitution, there can be employed a constitution in which the first electrically conductive piece is disposed on one surface of the insulating layer, the second electrically conductive piece is disposed on the other surface of the insulating layer, a through-hole portion is formed through the insulating layer, the discharge means and the second discharge means are disposed on the other surface side of the insulating layer, and one end of each of the discharge means and the second discharge means is electrically connected to the first electrically conductive piece through the through-hole portion. When the above constitution is employed, there can be obtained a small-sized and light-weighted portable static electricity eliminating apparatus.

There can be obtained, for example, various doors, doorways, gates, entrances and exits of stores, offices, hotels, rooms and automobiles; knobs of various doors, doorways, gates, entrances and exits of stores, offices, hotels, rooms and automobiles; a touch panel of an elevator; keys; key holders; various electronic machines and tools such as cellular phones, personal computers and game machines; integrated circuits and electronic parts; name cards; portable cards; rotary portions and transfer potions of various nozzles and transfer apparatuses; work tables, trays, containers and shelves; various pieces of metallic furnitures and metallic parts; metallic portions of structures and the like, to which the static electricity eliminating apparatus of the present invention is incorporated, provided or attached.

The above varistor refers to a two-terminal element of which the resistance value decreases non-linearly with an increase in an applied voltage. That is, the varistor is a two-terminal element that has a high resistance almost equivalent to the resistance of an insulating material up to a discharge start voltage but comes into almost a continuity state in a manner in which the resistance value sharply decreases when the voltage applied exceeds the discharge start voltage. The charge that is electrostatically induced in the first electrically conductive piece and the second electrically conductive piece and accumulated (stored) by dielectric polarization is consumed as heat due to the internal resistance of the varistor. That is, static electricity has a very high voltage but has a very small current value, so that it is fully consumed due to the internal resistance of the varistor. Specifically, the varistor can be classified into diode varistors (a cuprous oxide varistor, a selenium varistor, a silicon varistor and a silicon Zener diode) and ceramic varistors (a zinc oxide varistor, a barium titanate varistor and a silicon carbide varistor). In the present invention, it is preferred to use a ceramic varistor as a varistor for decreasing the size of the static electricity eliminating apparatus although the varistor shall not be limited thereto. Further, when the static electricity eliminating apparatus of the present invention is portable, it is desirable use a chip varistor, and when it is an attachment type (fixture type), it is desirable to use a varistor having a size that is as large as possible.

Further, the discharge tube refers to a kind of an electronic tube manufactured by exhausting a gas from a container so that the container has a low pressure and charging the container with a gas, and it utilizes electric properties and a light emission phenomenon caused by an impact-ionization activity between electrons emitted from a cathode and the charged gas or vapor. The discharge tube includes a neon tube that is a tube-shaped discharge lamp that emits light by a positive column of glow discharge of a neon gas mainly, and glow discharge lamps of the same type using an argon gas, mercury, a helium gas, a nitrogen gas and the like. The charge electrostatically induced in the first electrically conductive piece and the second electrically conductive piece and accumulated (stored) therein by dielectric polarization is consumed as light in the discharge of the discharge tube. The start, continuation and completion of the discharge can be confirmed by observing light emission in the discharge tube.

Further, the air gap refers to an aerial discharge gap spaced with two electrodes. The charge electrostatically induced in the first electrically conductive piece and the second electrically conductive piece and accumulated (stored) therein by dielectric polarization is consumed as heat by discharge in the air gap.

In the present invention, as a material for the insulating layer or a flat plate material for the insulating layer, it is preferred to use a material having an electric resistance value of $10^7$ ohm/cm or greater. Specific examples of the above material include plastics typified by an epoxy resin, a phenolic resin, an ABS resin and a modified polyphenylene ether (PPE) resin; leather; glass; paper; amber; and various rubber such as a natural rubber and a urethane rubber. Further, examples of the material for the first and second electrically conductive pieces or the first and second pipes and the rod-shaped material include metals and alloys typified by stainless steel, aluminum, an aluminum alloy, copper and a copper alloy; an electrically conductive rubber;.an electrically conductive fiber; and an electrically conductive paste cured product. As a method of forming the through-hole portion in the insulating layer, a proper method can be employed depending upon a material constituting the insulating layer.

The method of disposing the first electrically conductive piece and/or the second electrically conductive piece on the insulating layer includes a method in which the first electrically conductive piece and/or the second electrically conductive piece are/is bonded to the insulating layer with an adhesive; a method in which the first electrically conductive piece and/or the second electrically conductive piece are/is bonded to the insulating layer that works as an adhesive; a method in which the first electrically conductive piece and/or the second electrically conductive piece are/is formed on the surface of the insulating layer by a plating method; a method in which the first electrically conductive piece and/or the second electrically conductive piece are/is formed on the surface of the insulating layer by a printing method; a method in which the first electrically conductive piece and/or the second electrically conductive piece are/is formed on the surface of the insulating layer by a physical vapor deposition method (PVD method) typified by a vacuum vapor deposition method or a sputtering method; and a method in which the first electrically conductive piece and/or the second electrically conductive piece are/is formed on the surface of the insulating layer while the insulating layer is formed by an insert injection molding method. The method of disposing the first electrically conductive piece and/or the second electrically conductive piece on the insulating layer is selected from the above methods depending upon a material (for) forming the insulating layer.

The method of electrically connecting one end of the discharge means or the second discharge means to the first electrically conductive piece or the method of electrically connecting the other end of the discharge means or the second discharge means to the second electrically conductive piece includes, for example, soldering through a lead portion, a lead wire or a wiring, and an electrical connection method using an electrically conductive paste.

The static-electricity-charged object, which is a charged person, a charged matter or a charged article, touches, or comes or is brought into contact with, the first electrically conductive piece, a charge is electrostatically induced in the first electrically conductive piece and the second electrically conductive piece. The electrostatically induced charge is accumulated (stored) between the first electrically conductive piece and the second electrically conductive piece by dielectric polarization, and then, is discharged with the discharge means (or the discharge means and/or the second discharge means) in a state where the first electrically conductive piece and the second electrically conductive piece are not grounded. When, for example, a person then touches other metallic part (for example, an entrance to room, a gate, a doorknob, a touch panel of an elevator, a doorknob of an automobile or a metallic piece of furniture), no acute pain is provoked in (on) a human body. Otherwise, no discharge takes place between the matter or article and other metallic part. For example, when the second electrically conductive piece is grounded, even if the static electricity eliminating apparatus has the first electrically conductive piece and the second electrically conductive piece that are disposed so as to face each other through the insulating layer and has the discharge means having one end electrically connected to the first electrically conductive piece and the other end electrically connected to the second electrically conductive piece, the charge instantly flows into the ground, and as a result, an acute pain is provoked in (on) a human body in many cases. In the present invention, the first electrically conductive piece and the second electrically conductive piece are not grounded, the charge is consumed as heat or light in the discharge means and/or the second discharge means, and, a human body does not constitute any part of an element of a discharge circuit, so that no acute pain is provoked in (on) a human body.

When the static electricity eliminating apparatus of the present invention is incorporated into a key for opening and closing an automobile or a door, a charge can be eliminated by the mere contact of a person to the first electrically conductive piece of the static electricity eliminating apparatus of the present invention incorporated into the key but without touching any other place. As a result, even if the person then touches, or comes in contact with, the automobile or the door, the person suffers no impact.

In the static electricity eliminating apparatus of the present invention, further, the discharge of a charge is carried out inside the discharge means and/or the second discharge means, so that no external atmosphere influences the discharge. Further, in the transportation of a film or the step of manufacturing small-sized electronic parts, it is very difficult to ground the film or the electronic parts under transportation for eliminating charges accumulated in the film or the electronic parts during the transportation, so that it is conventional practice to employ an ion-generating apparatus or use a spray for eliminating static electricity. The present invention requires no grounding, so that the charge accumulated in a film or electronic parts during transportation can be easily eliminated.

The static electricity eliminating apparatus of the present invention can have the form of a portable type or an attachment type (fixture type) depending upon the field of use, and it can fully exhibit its effect in any type. Further, it is inconvenient to seek for a metallic portion of a structure or a door of an automobile to which the contact member is to be brought into contact, and a wiring (code) for grounding makes working troublesome. Such inconveniences can be fully removed.

The effects and advantages of the present invention explained above can be summarized as follows.

(1) A charge (static electricity) accumulated in a human body can be eliminated without any impact or unpleasant feeling by the mere contact of a person to the static electricity eliminating apparatus of the present invention but without touching any other place.

(2) The effect and advantage described in the above (1) can be effectively produced by attaching the static electricity eliminating apparatus of the present invention to a touch panel of an elevator, a doorknob of a hotel room, a door handle of an automobile, a doorknob of a building or the like.

(3) In the present invention, a charge is discharged inside the static electricity eliminating apparatus, so that no grounding is required. By attaching the static electricity eliminating apparatus to an electronic machine or tool or the like, therefore, static electricity can be eliminated while preventing a noise, etc., from the ground.

(4) An expensive ion-generating apparatus and electric power for generating an ion, required in the case of a conventional static electricity eliminating apparatus using ion, are no longer required.

(5) When the static electricity eliminating apparatus of the present invention is attached to a portable electronic machine or tool, not only the occurrence of a trouble caused on the portable electronic machine or tool by static electricity can be prevented, but also static electricity can be constantly eliminated from a person when the person carrying the portable electronic machine or tool touches, or comes in contact with, the first electrically conductive piece of the static electricity eliminating apparatus in the portable electronic machine or tool.

(6) The elimination of static electricity is a phenomenon which takes place in the discharge means or the second discharge means and is not influenced by any external atmosphere, and a charge is safely discharged with the discharge means or the second discharge means. There is therefore no limitation to be imposed on a place of use and the like.

(7) During movement or transfer of a matter or an article that is easily charged with static electricity in various manufacturing steps, the static electricity can be easily eliminated from the matter or article during the movement or transfer without grounding.

DESCRIPTION OF THE PREFERRED EMBODIMENTS

The present invention will be explained on the basis of Examples and with reference to drawings hereinafter, while the static electricity eliminating apparatus and the static electricity eliminating method of the present invention will be outlined prior thereto with reference to FIGS. 1A, 1B, 1C and 1D.

Figure 1A:
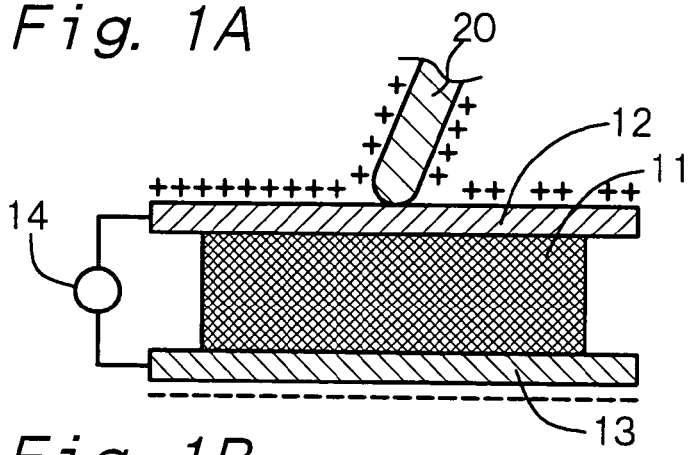
FIGS. 1A and 1B are a specific conceptual drawing and an equivalent circuit drawing of the first aspect of the static electricity eliminating apparatus and the static electricity eliminating method of the present invention, respectively, and, FIGS. 1C and 1D are a specific conceptual drawing and an equivalent circuit drawing of the second aspect of the static electricity eliminating apparatus and the static electricity eliminating method of the present invention, respectively.
Figure 1B:
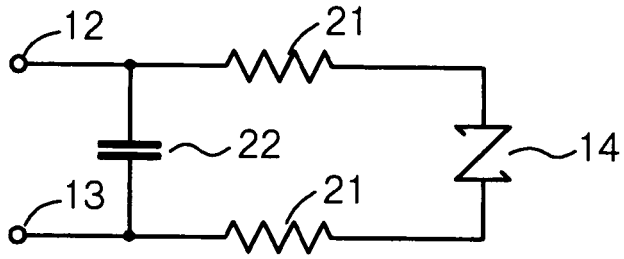
Figure 1C:
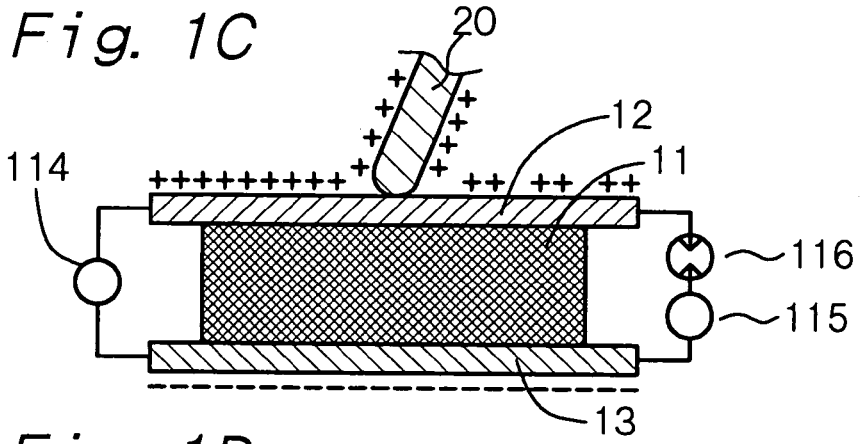
Figure 1D:
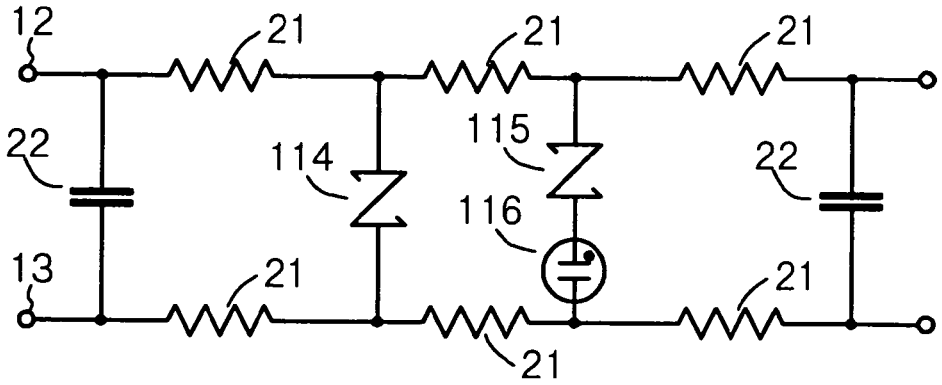

FIGS. 1A and 1B and FIGS. 1C and 1D show specific conceptual drawings and equivalent circuit drawings of the static electricity eliminating apparatus and the static electricity eliminating method of the present invention. The specific conceptual drawing shown in FIG. 1A and the equivalent circuit drawing shown in FIG. 1B are concerned with the first aspect of the present invention, and the specific conceptual drawing shown in FIG. 1C and the equivalent circuit drawing shown in FIG. 1D are concerned with the second aspect of the present invention. In FIGS. 1B and 1D, reference numeral 21 indicates a specific resistance value of electrically conductive pieces, and reference numeral 22 indicates a distributed capacitance of an insulating layer 11.

In the first aspect of the present invention, as shown in FIGS. 1A and 1B, the static electricity eliminating apparatus has a first electrically conductive piece 12 and a second electrically conductive piece 13 which are disposed so as to face each other through an insulating layer 11 and also has a discharge means having one end electrically connected to the first electrically conductive piece 12 and the other end electrically connected to the second electrically conductive piece 13. In the shown example of the first aspect of the present invention, the discharge means is constituted of a varistor 14. And, when a static-electricity-charged object 20 (for example, a finger of a person) touches, or comes in contact with, the first electrically conductive piece 12, a charge is electrostatically induced in the first electrically conductive piece 12 and the second electrically conductive piece 13, and the charge is accumulated between the first electrically conductive piece 12 and the second electrically conductive piece 13 by dielectric polarization, and then, is discharged with the discharge means in a state where the first electrically conductive piece 12 and the second electrically conductive piece 13 are not grounded. That is, when the static-electricity-charged object 20 touches, or comes in contact with, the first electrically conductive piece 12, a charge having a pole opposite to the pole of a charge in the first electrically conductive piece 12 is electrostatically induced in the second electrically conductive piece 13 which is disposed so as to face the first electrically conductive piece 12 through the insulating layer 11, and the charge (static electricity) is accumulated (stored) between the first electrically conductive piece 12 and the second electrically conductive piece 13 by dielectric polarization. And, when the potential difference between the first electrically conductive piece 12 and the second electrically conductive piece 13, caused by the above charge, comes to be the discharge start voltage of the varistor 14 or higher, the charge starts to be discharged with the varistor 14 that is the discharge means. Specifically, the above charge is consumed as a heat by the internal resistance of the varistor 14. Although not limited, the discharge start voltage of the varistor in various Examples according to the first aspect of the present invention is determined, for example, to be 280 volts.

In the second aspect of the present invention, as shown in FIGS. 1C and 1D, the static electricity eliminating apparatus further has a second discharge means having one end electrically connected to the first electrically conductive piece 12 and the other end electrically connected to the second electrically conductive piece 13. In the shown example of the second aspect of the present invention, the discharge means is constituted of a first varistor 114, and the second discharge means is constituted of a second varistor 115 and a discharge tube (more specifically, a neon tube) 116 connected in series. When a static-electricity-charged object 20 (for example, a finger of a person) touches, or comes in contact with, the first electrically conductive piece 12, a charge is electrostatically induced in the first electrically conductive piece 12 and the second electrically conductive piece 13, and the charge is accumulated between the first electrically conductive piece 12 and the second electrically conductive piece 13 by dielectric polarization, and then, is discharged with the first varistor 114 that is the discharge means and the second varistor 115 and the discharge tube 116 which constitute the second discharge means, in a state where the first electrically conductive piece 12 and the second electrically conductive piece 13 are not grounded. The discharge start voltage of the second discharge means is lower than the discharge start voltage of the discharge means. Specifically, when the static-electricity-charged object 20 touches, or comes in contact with, the first electrically conductive piece 12, a charge having a pole opposite to the pole of a charge in the first electrically conductive piece 12 is electrostatically induced in the second electrically conductive piece 13 which is disposed so as to face the first electrically conductive piece 12 through the insulating layer 11, and the charge (static electricity) is accumulated (stored) between the first electrically conductive piece 12 and the second electrically conductive piece 13 by dielectric polarization. And, when the potential difference between the first electrically conductive piece 12 and the second electrically conductive piece 13, caused by the above charge, comes to be the discharge start voltage of the second discharge means or higher, the charge starts to be discharged with the second varistor 115 and the discharge tube 116 which constitute the second discharge means. Specifically, the above charge is consumed as a heat by the internal resistance of the second varistor 115, consumed as light by the discharge tube 116 and consumed as heat by the internal resistance of the first varistor 114. Although not limited, the discharge start voltages of the first varistor, the second varistor and the discharge tube in various Examples according to the second aspect of the present invention is determined, for example, to be 280 volts, 24 volts and 80 volts, respectively. That is, the discharge start voltage of the discharge means is 280 volts, and the discharge start voltage of the second discharge means is 104 volts (=24 volts+80 volts).

EXAMPLE 1

Example 1 is concerned with a portable cylindrical static electricity eliminating apparatus.

Figure 2A:
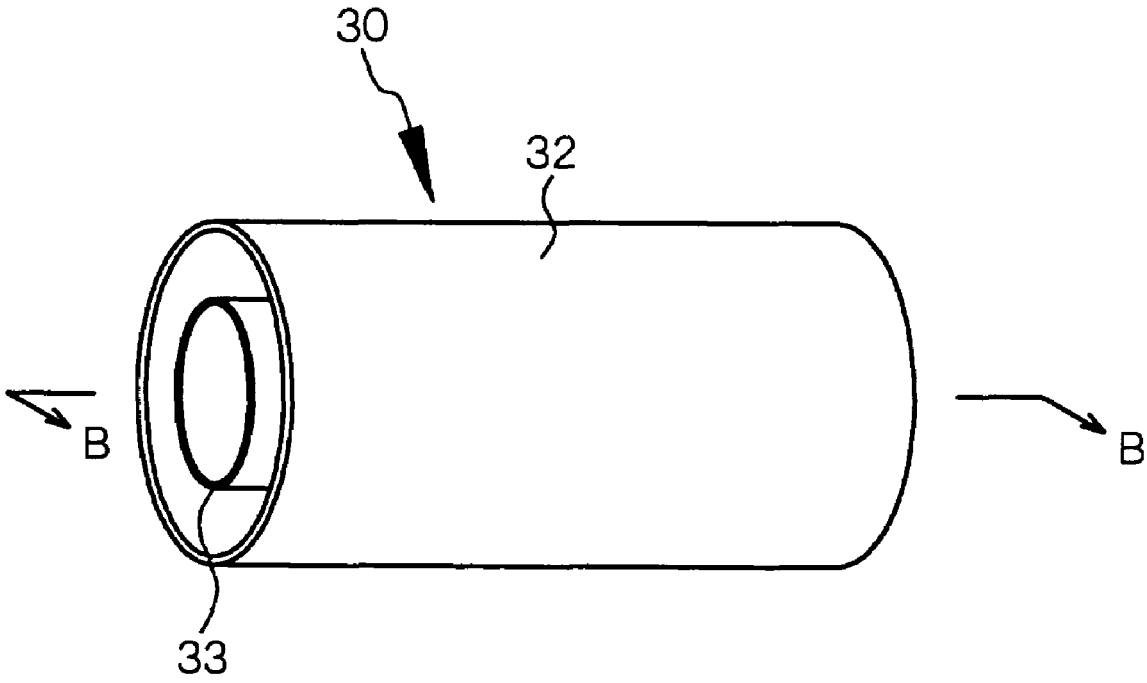
FIG. 2A is a schematic perspective view of a static electricity eliminating apparatus of Example 1 according to the first aspect of the present invention.
Figure 2B:
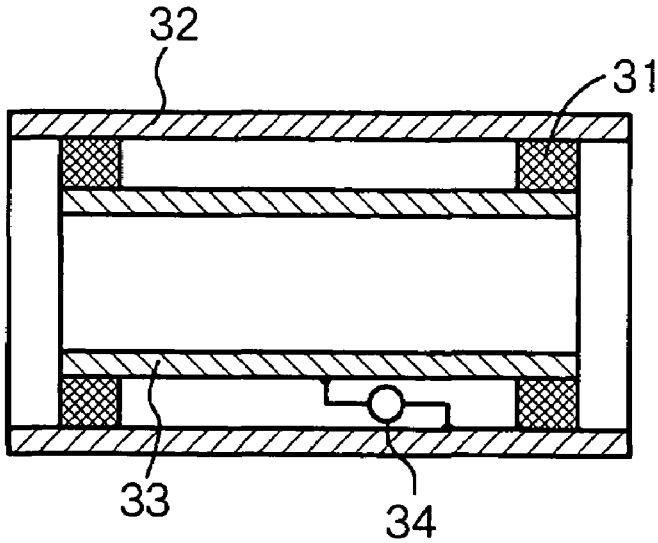
FIG. 2B is a schematic cross-sectional view of the static electricity eliminating apparatus of Example 1 according to the first aspect of the present invention, obtained by cutting the apparatus through a plane including the axial line thereof.
Figure 3A:
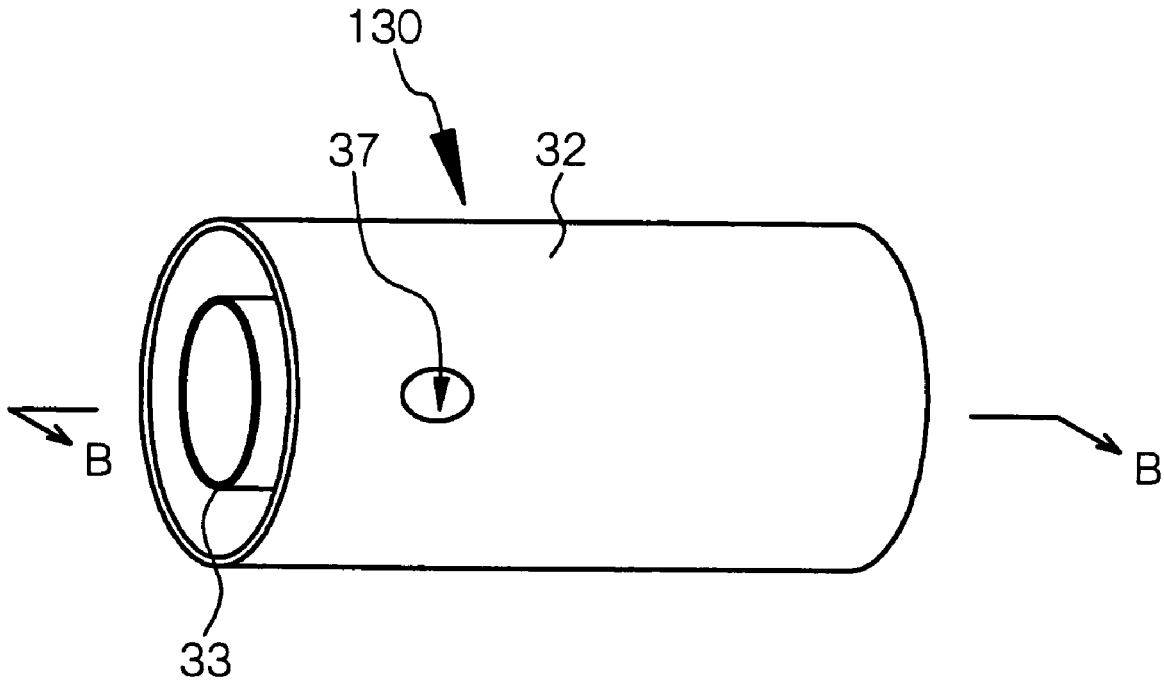
FIG. 3A is a schematic perspective view of a static electricity eliminating apparatus of Example 1 according to the second aspect of the present invention.
Figure 3B:
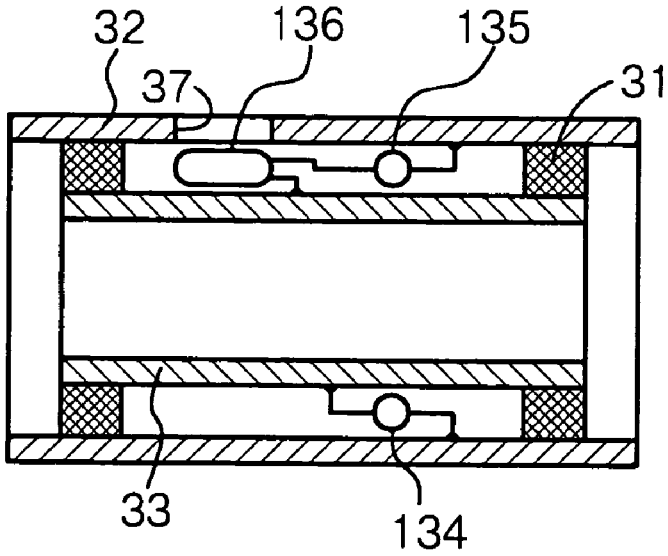
FIG. 3B is a schematic cross-sectional view of the static electricity eliminating apparatus of Example 1 according to the second aspect of the present invention, obtained by cutting the apparatus through a plane including the axial line thereof.

FIG. 2A shows a schematic perspective view of a static electricity eliminating apparatus 30 of Example 1 according to the first aspect of the present invention (to be referred to as "Example 1A" hereinafter). FIG. 2B shows a schematic cross-sectional view of the static electricity eliminating apparatus 30, taken by cutting it with a plane including arrows B—B in FIG. 2A. Further, FIG. 3B shows a schematic perspective view of a static electricity eliminating apparatus 130 of Example 1 according to the second aspect of the present invention (to be referred to as "Example 1B" hereinafter). FIG. 3B shows a schematic cross-sectional view of the static electricity eliminating apparatus 130, taken by cutting it with a plane including arrows B—B in FIG. 3A.

The static electricity eliminating apparatuses 30 and 130 of Examples 1A and 1B are portable and have the form of a cylinder. A first electrically conductive piece 32 and a second electrically conductive piece 33 are disposed so as to face each other through an insulating layer 31 (more specifically, the insulating layer 31 and an air layer). Specifically, the first electrically conductive piece 32 is formed of a hollow first pipe, and the second electrically conductive piece 33 is formed of a second pipe that is arranged inside the first electrically conductive piece 32 and which is fixed to the first electrically conductive piece 32 with the insulating layer 31. The first pipe and the second pipe are made of aluminum. Further, the insulating layer 31 is constituted of a hot-melt adhesive. The first electrically conductive piece 32 and the second electrically conductive piece 33 are not grounded.

In the static electricity eliminating apparatus 30 of Example 1A, a discharge means has one end electrically connected to the first electrically conductive piece 32 and the other end electrically connected to the second electrically conductive piece 33. Specifically, a varistor 34 that is a discharge means is disposed in a space existing between the first electrically conductive piece 32 and the second electrically conductive piece 33. The varistor 34 is a ceramic varistor, and more specifically, it is a zinc oxide varistor (discharge start voltage: 280 volts). One lead portion of the varistor 34 is soldered to an inner surface of the first electrically conductive piece 32, and the other lead portion of the varistor 34 is soldered to an outer surface of the second electrically conductive piece 33. In FIG. 2A, showing of the insulating layer 31 is omitted. When a static-electricity-charged object touches, or comes in contact with, the first electrically conductive piece 32, a charge is electrostatically induced in the first electrically conductive piece 32 and the second electrically conductive piece 33, and the charge is accumulated between the first electrically conductive piece 32 and the second electrically conductive piece 33 by dielectric polarization, and then, is discharged with the varistor 34 that is the discharge means in a state where the first electrically conductive piece 32 and the second electrically conductive piece 33 are not grounded.

The static electricity eliminating apparatus 130 of Example 1B is further provided with a second discharge means having one end electrically connected to the first electrically conductive piece 32 and the other end electrically connected to the second electrically conductive piece 33. When a static-electricity-charged object touches, or comes in contact with, the first electrically conductive piece 32, a charge is electrostatically induced in the first electrically conductive piece 32 and the second electrically conductive piece 32, and the charge is accumulated between the first electrically conductive piece 32 and the second electrically conductive piece 33 by dielectric polarization, and then, is discharged with the discharge means and/or the second discharge means in a state where the first electrically conductive piece 32 and the second electrically conductive piece 33 are not grounded. Specifically, the discharge means is constituted of a first varistor 134, the second discharge means is constituted of a second varistor 135 and a discharge tube 135 connected in series, and the discharge start voltage of the second discharge means is lower than the discharge start voltage of the discharge means. More specifically, the first varistor 134 is constituted of a zinc oxide varistor (discharge start voltage: 280 volts), the second varistor 135 is also constituted of a zinc oxide varistor (discharge start voltage: 24 volts), and the discharge tube is constituted of a neon tube (discharge start voltage: 80 volts). The discharge means and the second discharge means (the first varistor 134, the second varistor 135 and the discharge tube 136) are disposed in a space existing between the first electrically conductive piece 32 and the second electrically conductive piece 33. One lead portion of the first varistor 134 and one lead portion of the second varistor 135 are soldered to an inner surface of the first electrically conductive piece 32, the other lead portion of the first varistor 134 is soldered to an outer surface of the second electrically conductive piece 33, the other lead portion of the second varistor 135 is connected to the lead portion of the discharge tube 136 by soldering, and the other lead portion of the discharge tube 136 is soldered to the outer surface of the second electrically conductive piece 33. In FIG. 3A, showing of the insulating layer 31 is also omitted. Further, the first electrically conductive piece 32 has a window portion for observing a light emission state of the discharge tube 136 constituting the second discharge means.

A static electricity eliminating test was carried out with the static electricity eliminating apparatus 30 of Example 1A shown in FIGS. 2A and 2B. Specifically, 6 subjects particularly susceptible to static electricity were selected, and when each subject charged with static electricity gripped the first electrically conductive piece 32 of the static electricity eliminating apparatus 30, no impact occurred on the subject's body. Then, each subject touched other device made of metals. In this case, no impact occurred, so that it was confirmed that static electricity charged in a human body had been eliminated.

For comparison, the second electrically conductive piece 33 of the static electricity eliminating apparatus 30 of Example 1A shown in FIGS. 2A and 2B was grounded. When each of the subjects charged with static electricity gripped the first electrically conductive piece 32 of the static electricity eliminating apparatus 30, an impact occurred on the subject's body. The above results show that the portable static electricity eliminating apparatus of Example 1A can fully eliminate static electricity without causing an impact on a human body during discharging.

A static electricity eliminating test was also carried out with the static electricity eliminating apparatus 130 of Example 1B shown in FIGS. 3A and 3B. Specifically, 6 subjects particularly susceptible to static electricity were selected, and when each subject charged with static electricity gripped the first electrically conductive piece 32 of the static electricity eliminating apparatus 130, a charge was discharged with the first varistor 134, the second varistor 135 and the discharge tube 136, and lighting of the discharge tube 136 constituted of a neon tube was observed through the window portion 37. No impact occurred on the subject's body. Then, each subject touched other device made of metals. In this case, no impact occurred, so that it was confirmed that static electricity charged in a human body had been eliminated.

For comparison, the second electrically conductive piece 33 of the static electricity eliminating apparatus 130 of Example 1B shown in FIGS. 3A and 3B was grounded. When each of the subjects charged with static electricity gripped the first electrically conductive piece 32 of the static electricity eliminating apparatus 130, lighting of the discharge tube 136 constituted of a neon tube was observed through the window portion 37 and an impact occurred on the subject's body. The above results show that the portable static electricity eliminating apparatus of Example 1B can fully eliminate static electricity without causing an impact on a human body during discharging.

Similar tests were carried out in various Examples concerned with the first aspect and second aspect of the present invention to be explained later, and similar test results were obtained.

Figure 4:
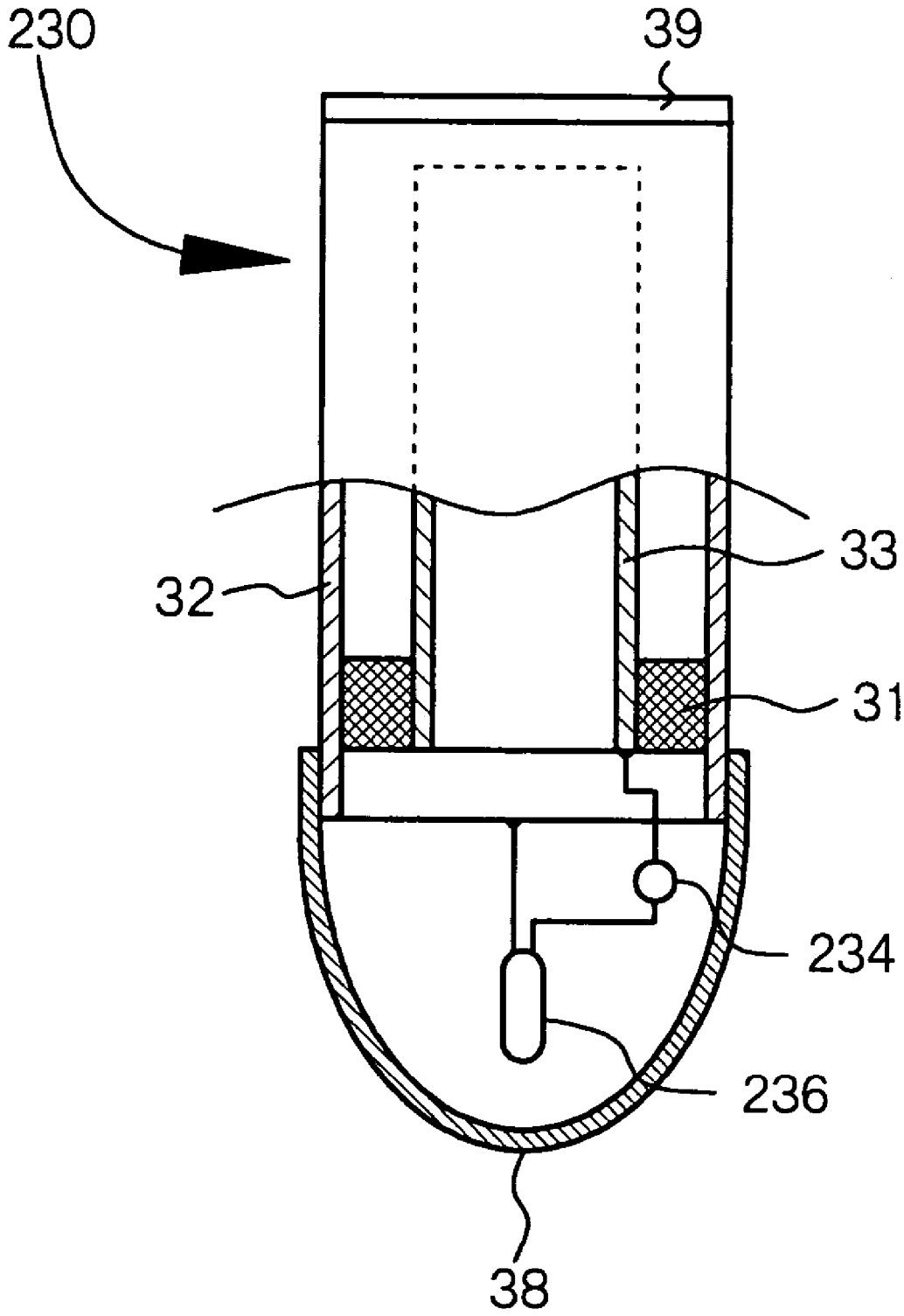
FIG. 4 is a schematic partially cut-off drawing of a variant of the static electricity eliminating apparatus of Example 1 according to the first aspect of the present invention.

FIG. 4 shows a variant of the static electricity eliminating apparatus of Example 1. FIG. 4 is a schematic partially cut-off drawing of the variant of the static electricity eliminating apparatus of Example 1, and the variant is concerned with a flashlight or fountain pen type static electricity eliminating apparatus. This static electricity eliminating apparatus 230 is also portable and cylindrical. A first electrically conductive piece 32, a second electrically conductive piece 33 and an insulating layer 31 can be structured and constituted like the first electrically conductive piece 32, the second electrically conductive piece 33 and the insulating layer 31 in the static electricity eliminating apparatus 30 shown in FIG. 2. A cap 38 made of a transparent resin is threadedly engaged with the top portion of the first electrically conductive piece 32. Further, a rid 39 made of aluminum is threadedly engaged with a backward portion of the first electrically conductive piece 32.

In the static electricity eliminating apparatus 230, the discharge means has one end electrically connected to the first electrically conductive piece 32 and the other end electrically connected to the second electrically conductive piece 33. Specifically, the discharge means is arranged in the cap 38. The discharge means is constituted of a varistor 234 (a zinc oxide varistor having a discharge start voltage of 24 volt) and a discharge tube 236 made of a neon tube (discharge start voltage: 80 volt) and connected to the varistor 234 in series. One lead portion of the varistor 234 is soldered to the second electrically conductive piece 33, the other lead portion of the varistor 234 is connected to one lead portion of the discharge tube 236 by soldering, and the other lead portion of the discharge tube 236 is soldered to the first electrically conductive piece 32. When a static-electricity-charged object touches, or comes in contact with, the first electrically conductive piece 32, a charge is electrostatically induced in the first electrically conductive piece 32 and the second electrically conductive piece 33, and the charge is accumulated between the first electrically conductive piece 32 and the second electrically conductive piece 33 by dielectric polarization, and then, is discharged with the varistor 234 and the discharge tube 236 that constitute the discharge means, in a state where the first electrically conductive piece 32 and the second electrically conductive piece 33 are not grounded. The operation state of the discharge tube 236 that shows a discharge state can be externally observed through the transparent cap 38.

EXAMPLE 2

Figure 5A:
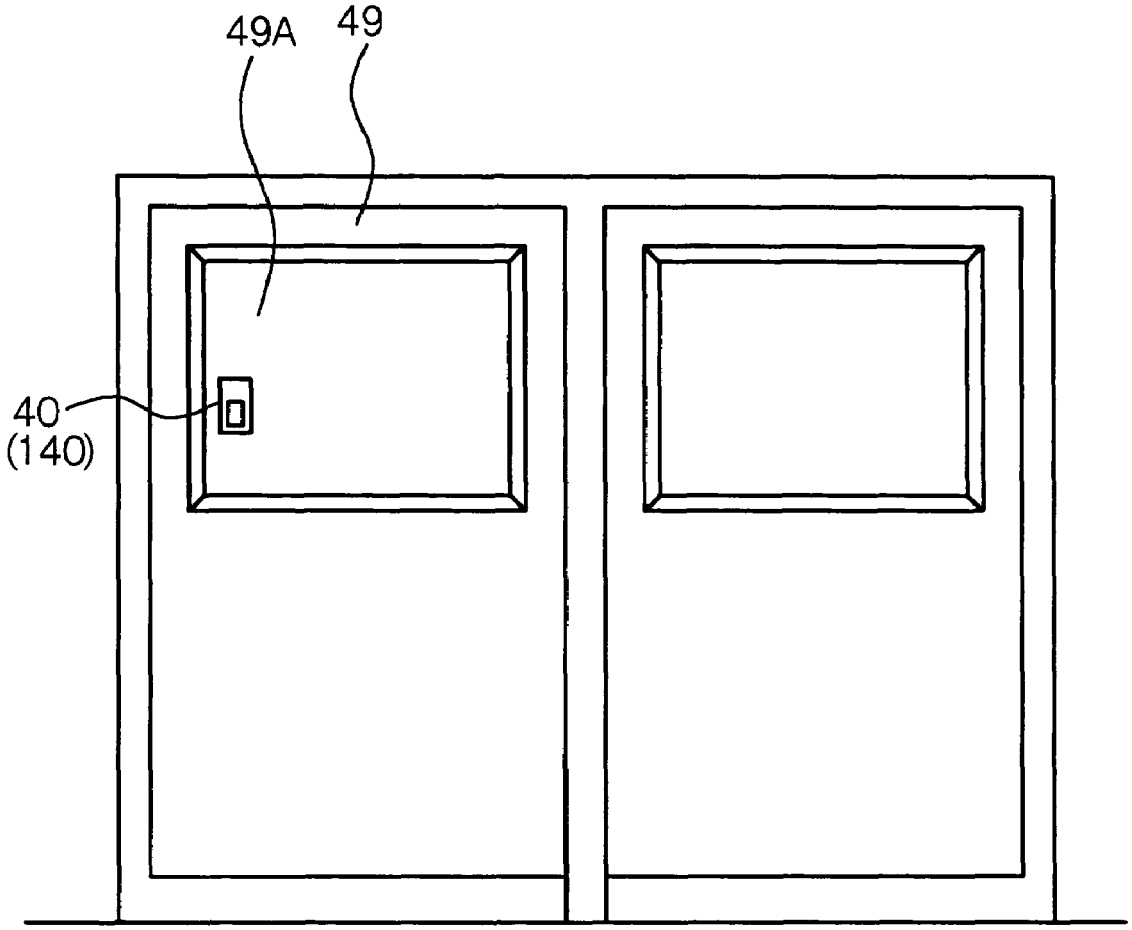
FIG. 5A schematically shows a state where a static electricity eliminating apparatus of Example 2 is fixed to a door at the entrance of a store.
Figure 5B:
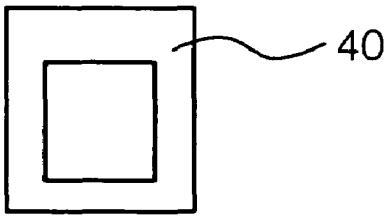
FIGS. 5B and 5C are schematic front views of the static electricity eliminating apparatuses of Example 2.
Figure 5C:
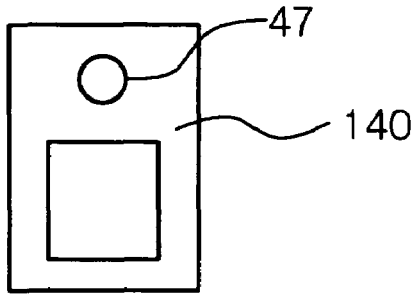
Figure 6A:
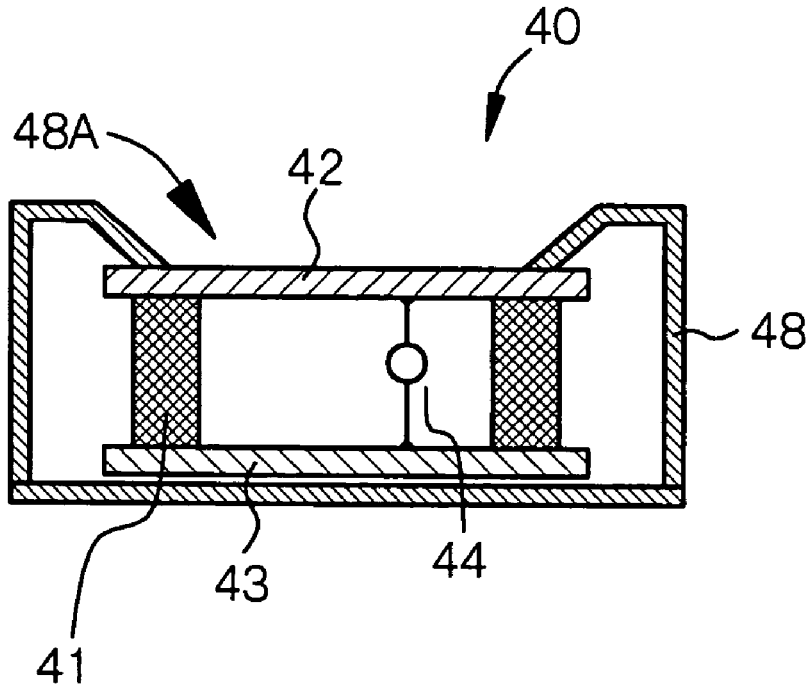
FIGS. 6A and 6B are schematic cross-sectional views of the static electricity eliminating apparatuses of Example 2.
Figure 6B:
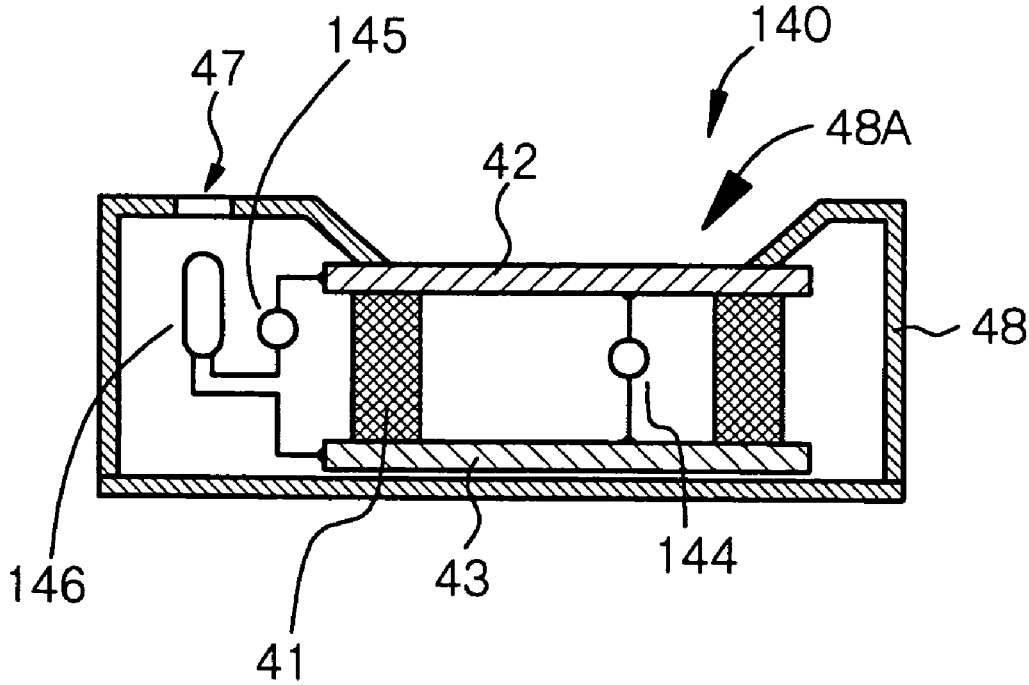

In Example 2, as shown in FIG. 5A, a static electricity eliminating apparatus is attached to a door 49 of an entrance to a store. Specifically, a static electricity eliminating apparatus 40 or 140 is attached to a surface a glass 49A of a glass window in the door 49 with a double-faced adhesive. FIG. 5B shows a schematic front view of the static electricity eliminating apparatus 40 of Example 2 according to the first aspect of the present invention (to be referred to as "Example 2A" hereinafter), and FIG. 6A shows a schematic cross-sectional view of the static electricity eliminating apparatus 40. Further, FIG. 5C shows a schematic front view of the static electricity eliminating apparatus 140 of Example 2 according to the second aspect of the present invention (to be referred to as "Example 2B" hereinafter), and FIG. 6B shows a schematic cross-sectional view of the static electricity eliminating apparatus 140.

The static electricity eliminating apparatuses 40 and 140 of Examples 2A and 2B have the external form of a box each. Each of a first electrically conductive piece 42 and a second electrically conductive piece 43 is formed of a thin plate made of stainless steel. The second electrically conductive piece 43 is fixed to the bottom of a housing 48 made of an ABS resin with an adhesive (not shown). A top surface of the housing 48 has an opening portion 48A, and the first electrically conductive piece 42 is fixed to the top surface of the housing 48 with an adhesive (not shown) so as to be exposed in the opening portion 48A. The first electrically conductive piece 42 and the second electrically conductive piece 43 are fixed with an insulating layer 41 made of a phenolic resin. That is, the first electrically conductive piece 42 and the second electrically conductive piece 43 are disposed so as to face each other through the insulating layer 41. The housing 48 can be sometimes regarded (used) as an insulating layer, and in such a case, the insulating layer 41 can be omitted.

In the static electricity eliminating apparatus 40 of Example 2A, a discharge means has one end electrically connected to the first electrically conductive piece 42 and the other end electrically connected to the second electrically conductive piece 43. Specifically, a varistor 44 as a discharge means is disposed in a space surrounded by the insulating layer 41, the first electrically conductive piece 42 and the second electrically conductive piece 43. One lead portion of the varistor 44 is soldered to the first electrically conductive piece 42, and the other lead portion of the varistor 44 is soldered to the second electrically conductive piece 43. The varistor 44 is the same as the varistor 34 in Example 1A. The first electrically conductive piece 42 and the second electrically conductive piece 43 are not grounded. When a static-electricity-charged object touches, or comes in contact with, the first electrically conductive piece 42, a charge is electrostatically induced in the first electrically conductive piece 42 and the second electrically conductive piece 43, and the charge is accumulated between the first electrically conductive piece 42 and the second electrically conductive piece 43 by dielectric polarization, and then, is discharged with the varistor 44 as a discharge means in a state where the first electrically conductive piece 42 and the second electrically conductive piece 43 are not grounded.

The static electricity eliminating apparatus 140 of Example 2B further has a second discharge means having one end electrically connected to the first electrically conductive piece 42 and the other end electrically connected to the second electrically conductive piece 43. When a static-electricity-charged object touches, or comes in contact with, the first electrically conductive piece 42, a charge is electrostatically induced in the first electrically conductive piece 42 and the second electrically conductive piece 43, and the charge is accumulated between the first electrically conductive piece 42 and the second electrically conductive piece 43 by dielectric polarization, and then, is discharged with the discharge means and/or the second discharge means in a state where the first electrically conductive piece 42 and the second electrically conductive piece 43 are not grounded. Specifically, the discharge means is constituted of a first varistor 144, and the second discharge means is constituted of a second varistor 145 and a discharge tube 146 connected in series. The discharge start voltage of the second discharge means is lower than the discharge start voltage of the discharge means. The first varistor 144, the second varistor 145 and the discharge tube 146 are the same as the first varistor 134, the second varistor 135 and the discharge tube 136 in Example 1B. The discharge means (the first varistor 144) is disposed in a space existing between the first electrically conductive piece 42 and the second electrically conductive piece 43, and the second discharge means (the second varistor 145 and the discharge tube 146) is disposed outside the insulating layer 41. One lead portion of the first varistor 144 and the one lead portion of the second varistor 145 are soldered to the first electrically conductive piece 42, the other lead portion of the first varistor 144 is soldered to the second electrically conductive piece 43, the other lead portion of the second varistor 145 is connected to one lead portion of the discharge tube 146 by soldering, and the other lead portion of the discharge tube 146 is soldered to the second electrically conductive piece 43. Further, the housing 48 has a window portion 47 for observing the light emission state of the discharge tube 146 constituting the second discharge means. The window portion 47 is filled with a transparent resin (not shown).

EXAMPLE 3

Figure 7A:
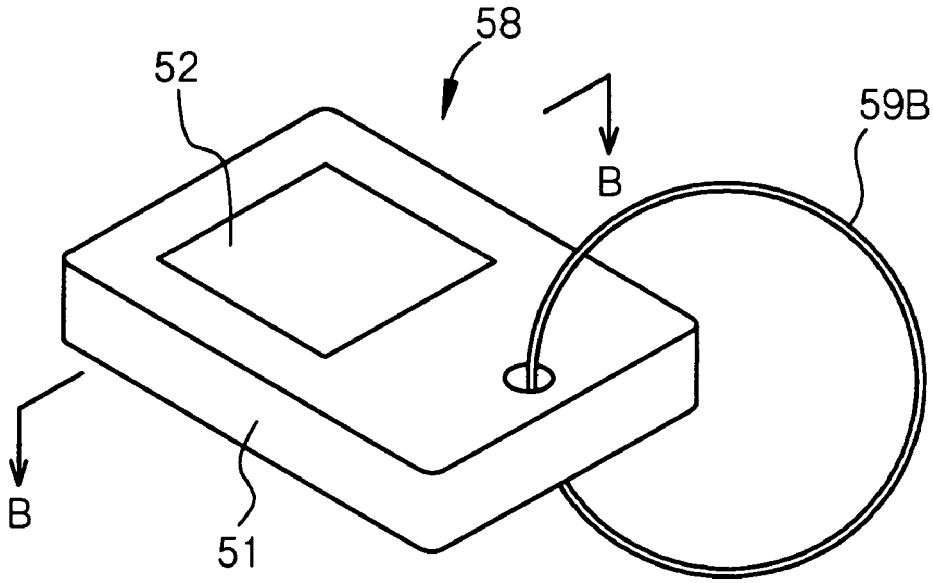
FIG. 7A is a schematic perspective view of a key holder into which a static electricity eliminating apparatus of Example 3 is incorporated.
Figure 7B:
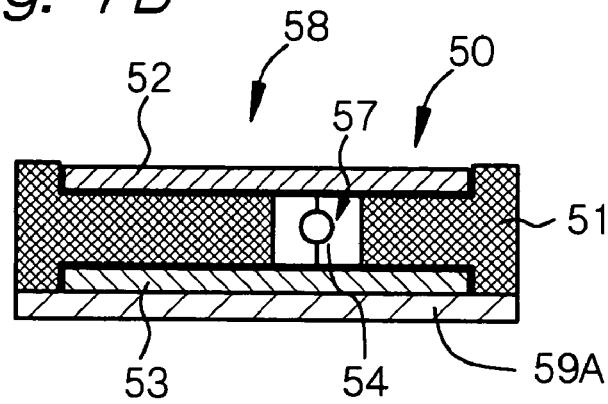
FIGS. 7B and 7C are schematic cross-sectional views of the key holders into each of which the static electricity eliminating apparatus of Example 3 is incorporated.
Figure 7C:
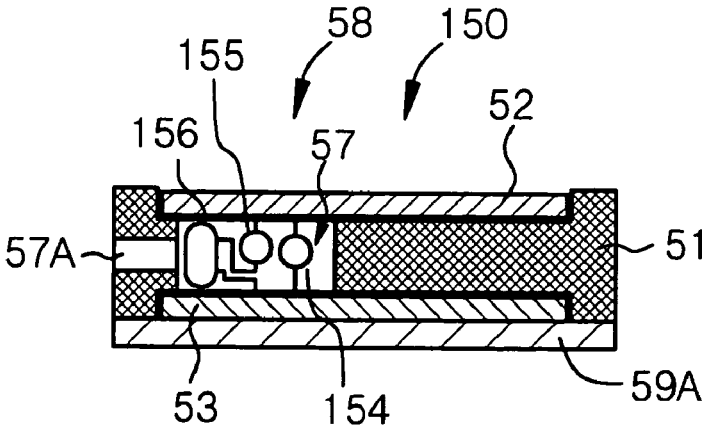

In Example 3, a static electricity eliminating apparatus 50 or 150 is incorporated into a key holder 58 as is shown in the schematic perspective view of FIG. 7A. FIG. 7B shows a schematic cross-sectional view of the key holder 58 of Example 3 according to the first aspect of the present invention (to be referred to as "Example 3A" hereinafter), taken by cutting it with a plane including arrows B—B in FIG. 7A. FIG. 7C shows a schematic cross-sectional view of the key holder 58 of Example 3 according to the second aspect of the present invention (to be referred to as "Example 3B" hereinafter), taken by cutting it with a plane including arrows B—B in FIG. 7A.

In each of Examples 3A and 3B, an insulating layer 51 is formed of a flat plate material, a first electrically conductive piece 52 is disposed on one surface of the insulating layer 51 formed of the flat plate material, and a second electrically conductive piece 53 is disposed on the other surface of the insulating layer 51 formed of the flat plate material. Specifically, each of the first electrically conductive piece 52 and the second electrically conductive piece 53 is formed of a thin plate made of stainless steel. The first electrically conductive piece 52 is bonded to the front surface of the insulating layer 51 formed of the flat plate material (material: phenolic resin) with an adhesive (not shown), and the second electrically conductive piece 53 is bonded to the reverse surface of the insulating layer 51 with an adhesive (not shown). That is, the first electrically conductive piece 52 and the second electrically conductive piece 53 are disposed so as to face each other through the insulating layer 51. The second electrically conductive piece 53 is covered with a cover 59A made of an ABS resin. Specifically, the cover 59A is bonded to the surface of the second electrically conductive piece 53 and the insulating layer 51. Reference numeral 59B indicates a ring for holding keys.

In the static electricity eliminating apparatus 50 of Example 3A, the flat plate material (insulating layer 51) has a through-hole portion 57, and a varistor 54 constituting a discharge means is arranged in the through-hole portion 57. The varistor 54 is the same as the varistor 34 in Example 1A. The varistor 54 constituting the discharge means has one end electrically connected to the first electrically conductive piece 52 and the other end electrically connected to the second electrically conductive piece 53. Specifically, one lead portion of the varistor 54 is connected to the first electrically conductive piece 52 with an electrically conductive paste, and the other lead portion of the varistor 54 is connected to the second electrically conductive piece 53 with an electrically conductive paste. The first electrically conductive piece 52 and the second electrically conductive piece 53 are not grounded. When a static-electricity-charged object touches, or comes in contact with, the first electrically conductive piece 52, a charge is electrostatically induced in the first electrically conductive piece 52 and the second electrically conductive piece 53, and the charge is accumulated between the first electrically conductive piece 52 and the second electrically conductive piece 53 by dielectric polarization, and then, is discharged with the varistor 54 as a discharge means in a state where the first electrically conductive piece 52 and the second electrically conductive piece 53 are not grounded.

The static electricity eliminating apparatus 150 of Example 3B further has a second discharge means having one end electrically connected to the first electrically conductive piece 52 and the other end electrically connected to the second electrically conductive piece 53. When a static-electricity-charged object touches, or comes in contact with, the first electrically conductive piece 52, a charge is electrostatically induced in the first electrically conductive piece 52 and the second electrically conductive piece 53, and the charge is accumulated between the first electrically conductive piece 52 and the second electrically conductive piece 53 by dielectric polarization, and then, is discharged with the discharge means and/or the second discharge means in a state where the first electrically conductive piece 52 and the second electrically conductive piece 53 are not grounded. Specifically, the discharge means is constituted of a first varistor 154, the second discharge means is constituted of a second varistor 155 and a discharge tube 156 connected in series, and the discharge start voltage of the second discharge means is lower than the discharge start voltage of the discharge means. The first varistor 154, the second varistor 155 and the discharge tube 156 are the same as the first varistor 134, the second varistor 135 and the discharge tube 136 in Example 1B. The flat plate material (insulating layer 51) has a through-hole portion 57, and the first varistor 154, the second varistor 155 and the discharge tube 156 are arranged in the through-hole portion 57. One lead portion of the first varistor 154 and one lead portion of the second varistor 155 are connected to the first electrically conductive piece 52 with an electrically conductive paste, the other lead portion of the first varistor 154 is connected to the second electrically conductive piece 53 with an electrically conductive paste, the other lead portion of the second varistor 155 is connected to one lead portion of the discharge tube 156 with an electrically conductive paste, and the other lead portion of the discharge tube 156 is connected to the second electrically conductive piece 53 with an electrically conductive paste. Further, the insulating layer 51 has a window portion 57A for observing the light emission state of the discharge tube 156 constituting the second discharge means. The window portion 57A is filled with a transparent resin (not shown).

EXAMPLE 4

Figure 8A:
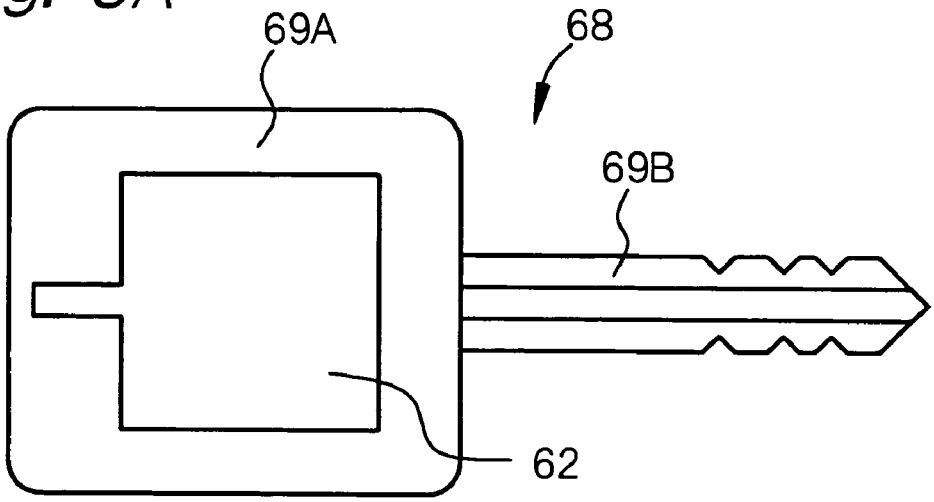
FIG. 8A is a schematic plan view of a key into which a static electricity eliminating apparatus of Example 4 is incorporated.
Figure 8B:
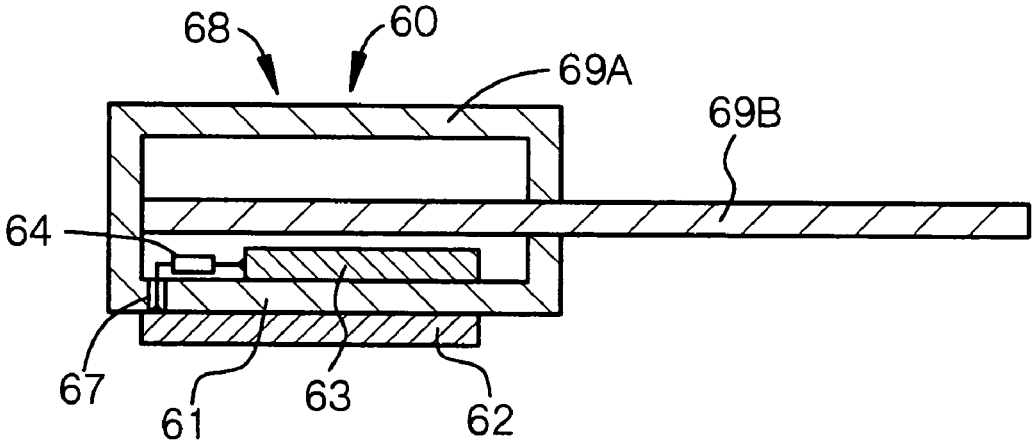
FIGS. 8B and 8C are schematic cross-sectional views of the keys into each of which the static electricity eliminating apparatus of Example 4 is incorporated.
Figure 8C:
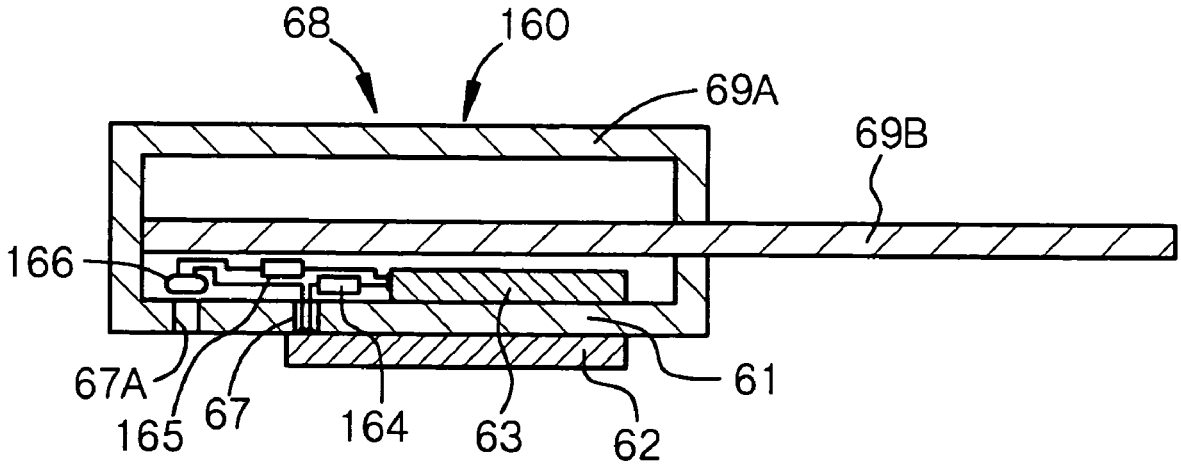

In Example 4, as shown in the schematic plan view of FIG. 8A and in the schematic cross-sectional view of FIGS. 8B or 8C, a static electricity eliminating apparatus 60 or 160 is incorporated into a key 68 for a door of an automobile. The key 68 comprises a body portion 69A, the static electricity eliminating apparatus 60 or 160 incorporated into the body portion 69A and a teeth (also called "bit") 69B.

In Example 4 concerned with the first aspect of the present invention (to be referred to as "Example 4A" hereinafter) and in Example 4 concerned with the second aspect of the present invention (to be referred to as "Example 4B" hereinafter), an insulating layer 61 is constituted of part of the body portion 69A. The body portion 69A is formed of a phenolic resin. A first electrically conductive piece 62 formed of a thin plate made of stainless steel is disposed on one surface of the insulating layer 61, and a second electrically conductive piece 63 formed of a thin plate made of stainless steel is disposed on the other surface of the insulating layer 61. Specifically, the first electrically conductive piece 62 is bonded to one surface of the insulating layer 61 with an adhesive (not shown), and the second electrically conductive piece 63 is bonded to the other surface of the insulating layer 61 with an adhesive (not shown). The first electrically conductive piece 62 is positioned in an outer surface of the body portion 69A, and the second electrically conductive piece 63 is positioned in an inner surface of the body portion 69A.

In Example 4A shown in the schematic cross-sectional view of FIG. 8B, the insulating layer 61 has a through-hole portion 67, and a varistor 64 as a discharge means is disposed on the other surface side of the insulating layer 61 (inside the body portion 69A). One end of the varistor 64 as a discharge means is electrically connected to the first electrically conductive piece 62 through the through-hole portion 67. Specifically, one lead portion of the varistor 64 is led through the through-hole portion 67 and is connected to the first electrically conductive piece 62 with an electrically conductive paste. The other lead portion of the varistor 64 is connected to the second electrically conductive piece 63 with an electrically conductive paste. The first electrically conductive piece 62 and the second electrically conductive piece 63 are not grounded. When a static-electricity-charged object touches, or comes in contact with, the first electrically conductive piece 62, a charge is electrostatically induced in the first electrically conductive piece 62 and the second electrically conductive piece 63, and the charge is accumulated between the first electrically conductive piece 62 and the second electrically conductive piece 63 by dielectric polarization, and then, is discharged with the varistor 64 as a discharge means in a state where the first electrically conductive piece 62 and the second electrically conductive piece 63 are not grounded.

The static electricity eliminating apparatus 160 of Example 4B shown in the schematic cross-sectional view of FIG. 8C further has a second discharge means having one end electrically connected to the first electrically conductive piece 62 and the other end electrically connected to the second electrically conductive piece 63. The insulating layer 61 has a through-hole portion 67, the discharge means and the second discharge means are disposed on the other surface side of the insulating layer 61 (inside the body portion 69A), one end of the discharge means is electrically connected to the first electrically conductive piece 62 through the through-hole portion 67, and one end of the second discharge means is also electrically connected to the electrically conductive piece 62 through the through-hole portion 67. When a static-electricity-charged object touches, or comes in contact with, the first electrically conductive piece 62, a charge is electrostatically induced in the first electrically conductive piece 62 and the second electrically conductive piece 63, and the charge is accumulated between the first electrically conductive piece 62 and the second electrically conductive piece 63 by dielectric polarization, and then, is discharged with the discharge means and/or the second discharge means in a state where the first electrically conductive piece 62 and the second electrically conductive piece 63 are not grounded.

Specifically, the discharge means is constituted of a varistor 164, and the second discharge means is constituted of a second varistor 165 and a discharge tube 166 connected in series. The discharge start voltage of the second discharge means is lower than the discharge start voltage of the discharge means. The first varistor 164, the second varistor 165 and the discharge tube 166 are the same as the first varistor 134, the second varistor 135 and the discharge tube 136 in Example 1B. The insulating layer 61 has a through-hole portion 67, and the first varistor 164, the second varistor 165 and the discharge tube 166 are arranged inside the body portion 69A. One lead portion of the first varistor 164 and one lead portion of the discharge tube 166 are led through the through-hole portion 67 and are connected to the first electrically conductive piece 62 with an electrically conductive paste, the other lead portion of the first varistor 164 is connected to the second electrically conductive piece 63 with an electrically conductive paste, the other lead portion of the discharge tube 166 is electrically connected to one lead portion of the second varistor 165 with an electrically conductive paste, and the other lead portion of the second varistor 165 is connected to the second electrically conductive piece 63 with an electrically conductive paste. Further, the insulating layer 61 has a window portion 67A for observing the light emission state of the discharge tube 166 constituting the second discharge means. The window portion 67A is filled with a transparent resin (not shown).

EXAMPLE 5

Figure 9A:
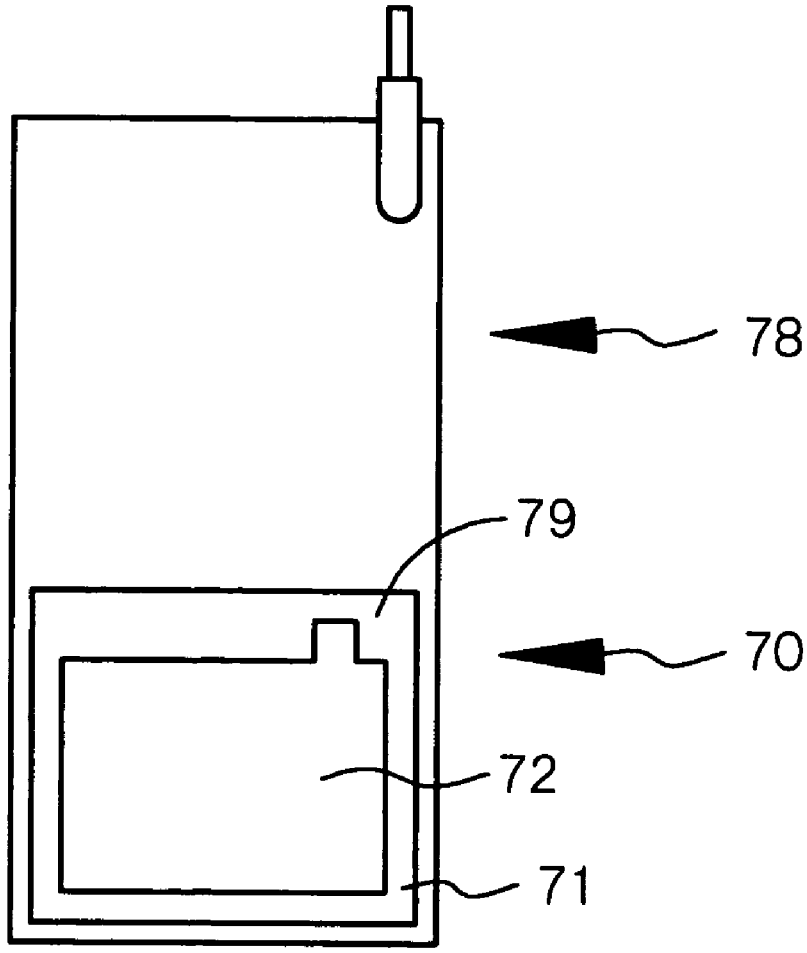
FIG. 9A is a schematic backside view of a cellular phone into which a static electricity eliminating apparatus of Example 5 is incorporated.

In Example 5, a static electricity eliminating apparatus 70 according to the first aspect of the present invention is incorporated into a cellular phone 78. FIG. 9A shows a schematic backside view of the cellular phone 78, and FIG. 9B shows a schematic drawing of a reverse surface of a back cover 79.

In Example 5 concerned with the first aspect of the present invention, an insulating layer 71 is constituted of part of the back cover 79. The back cover 79 is formed of a phenolic resin. A first electrically conductive piece 72 formed of a thin plate made of stainless steel is disposed on one surface (outer surface) of the back cover 79 corresponding to the insulating layer 71. A second electrically conductive piece 73 formed of a thin plate made of stainless steel is disposed on the other surface (reverse surface) of the back cover 79 corresponding to the insulating layer 71. Specifically, the first electrically conductive piece 72 is bonded to one surface of the insulating layer 71 with an adhesive (not shown), and the second electrically conductive piece 73 is bonded to the other surface of the insulating layer 71 with an adhesive (not shown).

Figure 9B:
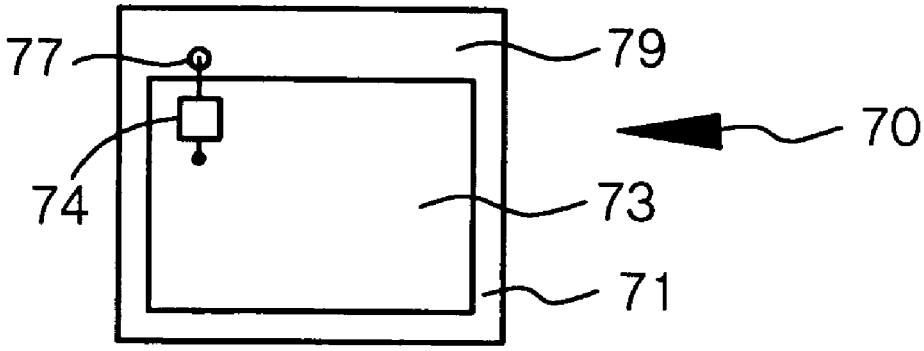
FIG. 9B is a schematic drawing of reverse surface of a back cover of the cellular phone.

As shown in the schematic drawing of FIG. 9B, the back cover 79 (insulating layer 71) has a through-hole portion 77, and a varistor 74 as a discharge means is disposed on the other surface side of the insulating layer 71 (on the reverse surface of the back cover 79). One end of the varistor 74 as a discharge means is electrically connected to the first electrically conductive piece 72 through the through-hole portion 77. Specifically, one lead portion of the varistor 74 is led through the through-hole portion 77 and is connected to the first electrically conductive piece 72 with an electrically conductive paste, and the other lead portion of the varistor 74 is connected to the second electrically conductive piece 73 with an electrically conductive paste. The first electrically conductive piece 72 and the second electrically conductive piece 73 are not grounded. When a static-electricity-charged object touches, or comes in contact with, the first electrically conductive piece 72, a charge is electrostatically induced in the first electrically conductive piece 72 and the second electrically conductive piece 73, and the charge is accumulated between the first electrically conductive piece 72 and the second electrically conductive piece 73 by dielectric polarization, and then, is discharged with the varistor 74 as a discharge means in a state where the first electrically conductive piece 72 and the second electrically conductive piece 73 are not grounded.

When used in an electronic machine or tool such as a cellular phone, a discharge tube or an air gap may sometimes cause a nose, so that it is preferred to use a varistor as a discharge means therein.

EXAMPLE 6

Figure 10:
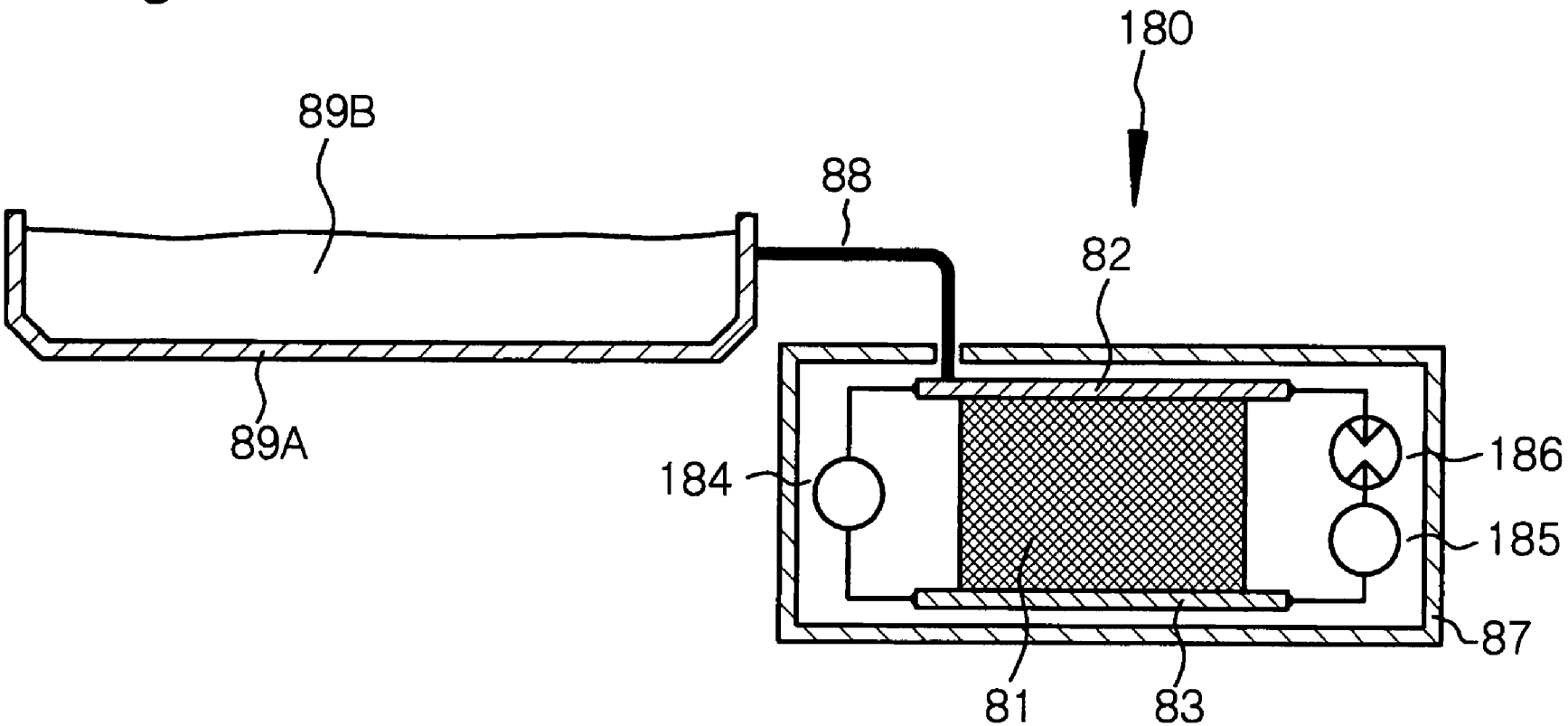
FIG. 10 is a schematic drawing of an apparatus for producing a resin, in which a static electricity eliminating apparatus of Example 6 is incorporated.

In Example 6, as shown in the schematic drawing of FIG. 10, a static electricity eliminating apparatus 180 according to the second aspect of the present invention is incorporated into an apparatus for producing a resin. While the static electricity eliminating apparatuses explained in Examples 1 to 5 are a kind of portable type. The static electricity eliminating apparatus 180 of Example 6 is a kind of attachment type (fixed type).

In the static electricity eliminating apparatus 180 of Example 6, a fist electrically conductive piece 82 formed of a thin plate made of stainless steel and a second electrically conductive piece 83 formed of a thin plate made of stainless steel are disposed so as to face each other through an insulating layer 81 made of a phenolic resin. Further, a discharge means has one end electrically connected to the first electrically conductive piece 82 and the other end electrically connected to the second electrically conductive piece 83. The static electricity eliminating apparatus 180 of Example 6 further has a second discharge means having one end electrically connected to the first electrically conductive piece 82 and the other end electrically connected to the second electrically conductive piece 83. Specifically, the discharge means is constituted of a first varistor 184, and the second discharge means is constituted of a second varistor 185 and a discharge tube 186 connected in series. The discharge start voltage of the second discharge means is lower than the discharge start voltage of the discharge means. More specifically, the first varistor 184 is formed of a zinc oxide varistor (discharge start voltage: 240 volts), the second varistor 185 is also formed of a zinc oxide varistor (discharge start voltage: 39 volts), and the discharge tube 186 is formed of a neon tube (discharge start voltage: 80 volts). One lead portion of the first varistor 184 and one lead portion of the discharge tube 186 are soldered to the first electrically conductive piece 82, the other lead portion of the first varistor 184 is soldered to the second electrically conductive piece 83, the other lead portion of the discharge tube 186 is connected to one lead portion of the second varistor 185 by soldering, and the other lead portion of the second varistor 185 is soldered to the second electrically conductive piece 83. A housing 87 has a window portion (not shown) for observing the light emission state of the discharge tube 186 constituting the second discharge means.

In Example 6, the first electrically conductive piece 82 is electrically connected, through a wiring 88, to a tray 89A made of a metal in which a paraffin-group resin 89B is to be placed.

The melted paraffin-group resin placed in the tray 89A is dried in a drying furnace, and after the tray is taken out of the drying furnace, the paraffin-group resin 89B is taken out of the tray 89A. In this case, the tray 89A is charged with static electricity having approximately 30 kilovolts to 45 kilovolts. The tray 89A in such a state corresponds to a static-electricity-charged object. The first electrically conductive piece 82 is electrically connected to the tray 89A through the wiring 88, that is, the static-electricity-charged object is in a state where it is in indirect contact with the first electrically conductive piece or it is kept in indirect contact with the first electrically conductive piece. Therefore, a charge electrostatically induced in the first electrically conductive piece 82 and the second electrically conductive piece 83 is accumulated between the first electrically conductive piece 82 and the second electrically conductive piece 83 by dielectric polarization, and then, is discharged with the discharge means and/or the second discharge means in a state where the first electrically conductive piece 82 and the second electrically conductive piece 83 are not grounded. That is, when the resin 89B is taken out of the tray 89A, static electricity charged in the tray 89A is eliminated by the static electricity eliminating apparatus 180, and the charging of the resin 89B and the tray 89A can be eliminated. The discharging of the charge can be confirmed through a window portion (not shown) made for observing the light emission state of the discharge tube 186.

When the resin 89B that is taken out is charged with static electricity, for example, a brush made of a metal is attached to the forward end of the wiring 88, and the brush is brought into contact with the resin 89B, whereby static electricity can be eliminated from the resin 89B. The static electricity of articles or parts under transfer or transportation can be also eliminated by the same method. In Example 6, the static electricity eliminating apparatus according to the second aspect of the present invention has been explained, while the static electricity eliminating apparatus according to the first aspect of the present invention can be also used instead.

EXAMPLE 7

Figure 11:
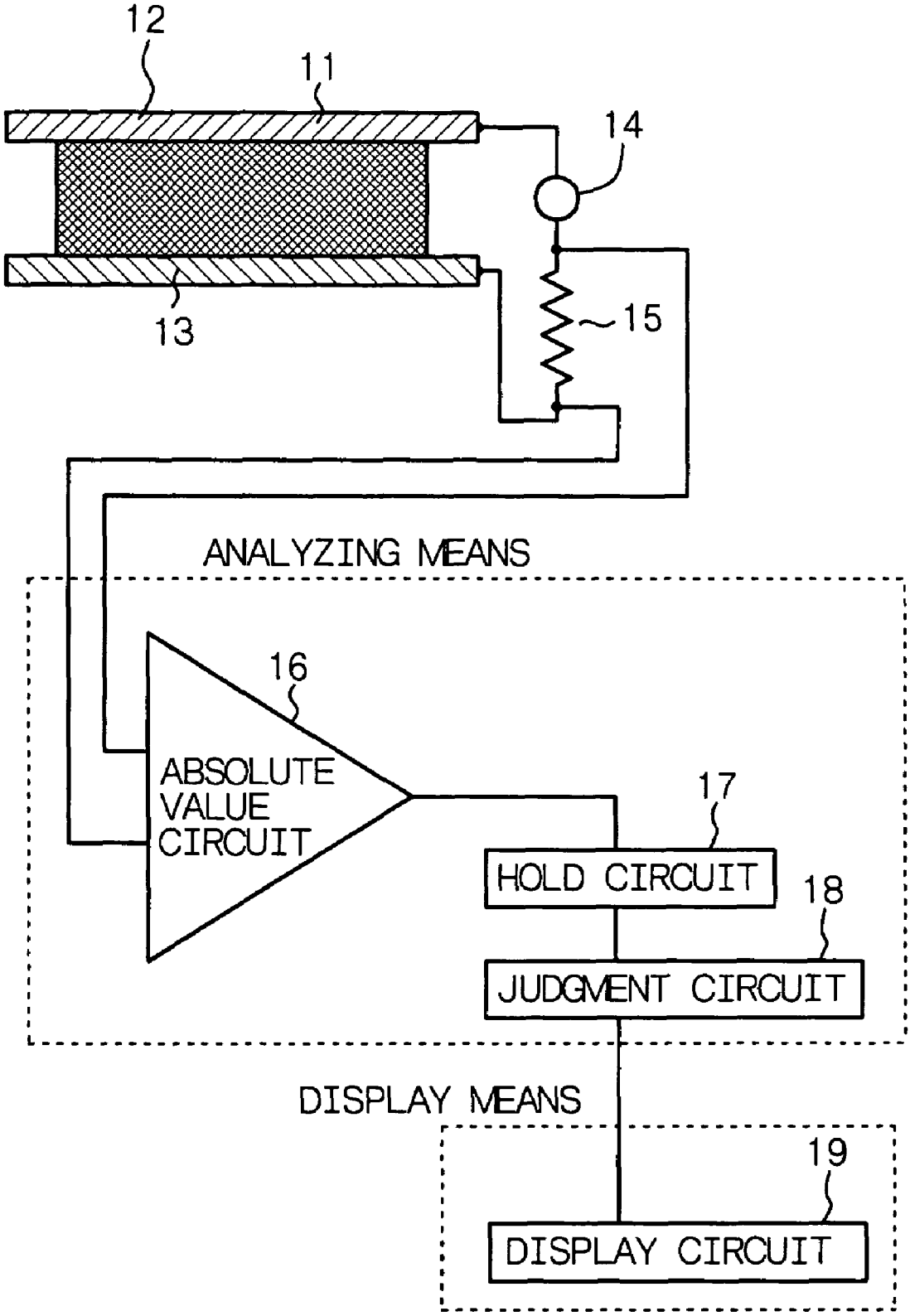
FIG. 11 is a schematic drawing of a static electricity eliminating apparatus of Example 7 having a discharge detection circuit having an analyzing means and a display means.

In Examples 1 to 4 and 6, the discharge tube is used to observe a discharge state. Alternatively, the discharge state can be also investigated with a discharge detection circuit having an analyzing means and a display means shown in FIG. 11. That is, a static electricity eliminating apparatus in Example 7 further has a resistor connected to a discharge means (or a second discharge means) in series, an analyzing means for analyzing a voltage between the two ends of the resistor, and a display means for showing an analysis result. Specifically, the resistor is connected to the discharge means (or second discharge means) in series, and a voltage between the two ends of the resistor is taken out and analyzed, to display an elimination state of a charge (static electricity). That is, the static electricity eliminating apparatus of Example 7 shown in FIG. 11 has a resistor 15 connected to the varistor 14 in series between the varistor 14 and the second electrically conductive piece 13 in the static electricity eliminating apparatus shown in FIG. 1A. That is, the analyzing means comprises an absolute value circuit 16, a hold circuit 17 and a judgment circuit 18, and the display means comprises a display circuit 19. This constitution can be also applied to the second aspect of the present invention.

When a static-electricity-charged object touches, or comes in contact with, the first electrically conductive piece 12, a charge is electrostatically induced in the first electrically conductive piece 12 and the second electrically conductive piece 13, and the charge is accumulated between the first electrically conductive piece 12 and the second electrically conductive piece 13 by dielectric polarization, and then, is discharged with the discharge means (specifically, a current flows in the varistor 14) in a state where the first electrically conductive piece 12 and the second electrically conductive piece 13 are not grounded. In this case, the current also flows in the resistor 15 connected to the varistor 14 in series. And, a voltage between the two ends of the resistor 15 is taken out and arranged to be a positive potential in the absolute value circuit 16 for arranging the polarity of an input voltage, and an output from the absolute value circuit 16 is held in the hold circuit 17. Then, an output (potential) from the hold circuit 17 is compared with standard values in the judgment circuit 18, and the magnitude of the potential is displayed with the display circuit 19 on the basis of three classified grades; 10 kilovolts or higher, 1 kilovolt or higher but less than 10 kilovolts, and less than 1 kilovolt, for example, by means of a light-emitting diode to emit light in red (for example, 10 kilovolts or higher), a light-emitting diode to emit light in yellow (for example, 1 kilovolt or higher but less than 10 kilovolts) and a light-emitting diode to emit light in green (for example, less than 1 kilovolt). Alternatively, the magnitude of the potential compared with the standard values in the judgment circuit 18 can be indicated by sound or voice. The analyzing means and the display means are driven by a battery that is not shown.

In the above constitution, a charge can be detected, or a discharge state or a charge elimination state can be confirmed, without requiring an expensive special device, as a potential sensor, such as a radioactive substance, a vibration type chopper or the like.

While the present invention has been explained on the basis of preferred Examples hereinabove, the present invention shall not be limited to these Examples. While Examples have explained constitutions and structures of the static electricity eliminating apparatus, constitutions and structures of the discharge means and the second discharge means, constitutions and structures of the products in which the static electricity eliminating apparatus is incorporated, parts used in the static electricity eliminating apparatus and articles into which the static electricity eliminating apparatus is incorporated and specifications and materials thereof, these are given as examples and may be modified or altered as required.

What is claimed is:

1. A static electricity eliminating apparatus comprising;

(A) a first electrically conductive piece and a second electrically conductive piece which are disposed so as to face each other through an insulating layer, and (B) a discharge means having one end electrically connected to the first electrically conductive piece and other end electrically connected to the second electrically conductive piece, wherein a charge electrostatically induced in the first electrically conductive piece and the second electrically conductive piece due to a contact of a static-electricity-charged object with the first electrically conductive piece is accumulated between the first electrically conductive piece and the second electrically conductive piece by dielectric polarization, and then, the charge is discharged with the discharge means in a state where the first electrically conductive piece and the second electrically conductive piece are not grounded.

2. The static electricity eliminating apparatus according to claim 1, in which the discharge means is constituted of a varistor.

3. The static electricity eliminating apparatus according to claim 1, in which the static electricity eliminating apparatus further has a resistor connected to the discharge means in series, an analyzing means for analyzing a voltage between the two ends of the resistor and a display means for displaying an analysis result.

4. The static electricity eliminating apparatus according to claim 1, in which the first electrically conductive piece is formed of a hollow first pipe and the second electrically conductive piece is formed of a second pipe or a rod-shaped material arranged inside the first electrically conductive piece and fixed to the first electrically conductive piece with the insulating layer.

5. The static electricity eliminating apparatus according to claim 1, in which the insulating layer is formed of a flat plate material, the first electrically conductive piece is disposed on one surface of the insulating layer, and the second electrically conductive piece is disposed on the other surface of the insulating layer.

6. The static electricity eliminating apparatus according to claim 5, in which a through-hole portion is formed through the insulating layer, and the discharge means is arranged in the through-hole portion.

7. The static electricity eliminating apparatus according to claim 1, in which the first electrically conductive piece is disposed on one surface of the insulating layer, the second electrically conductive piece is disposed on the other surface of the insulating layer, a through-hole portion is formed through the insulating layer, the discharge means is disposed on the other surface side of the insulating layer, and one end of the discharge means is electrically connected to the first electrically conductive piece through the through-hole portion.

8. The static electricity eliminating apparatus according to claim 1, in which the static electricity eliminating apparatus further has a second discharge means having one end electrically connected to the first electrically conductive piece and the other end electrically connected to the second electrically conductive piece, wherein a charge electrostatically induced in the first electrically conductive piece and the second electrically conductive piece due to a contact of a static-electricity-charged object with the first electrically conductive piece is accumulated between the first electrically conductive piece and the second electrically conductive piece by dielectric polarization, and then, the charge is discharged with the discharge means and the second discharge means in a state where the first electrically conductive piece and the second electrically conductive piece are not grounded.

9. The static electricity eliminating apparatus according to claim 8, in which the static electricity eliminating apparatus further has a resistor connected to the discharge means or the second discharge means in series, an analyzing means for analyzing a voltage between the two ends of the resistor and a display means for displaying an analysis result.

10. The static electricity eliminating apparatus according to claim 8, in which the discharge means is constituted of a first varistor, the second discharge means is constituted of a second varistor and a discharge tube connected in series, and the discharge start voltage of the second discharge means is lower than the discharge start voltage of the discharge means.

11. The static electricity eliminating apparatus according to claim 8, in which the first electrically conductive piece is formed of a hollow first pipe and the second electrically conductive piece is formed of a second pipe or rod-shaped material arranged inside the first electrically conductive piece and fixed to the first electrically conductive piece with the insulating layer.

12. The static electricity eliminating apparatus according to claim 11, in which a window portion for observing the light emission state of the discharge tube constituting the second discharge means is provided in the first electrically conductive piece or in the first electrically conductive piece and the second electrically conductive piece.

13. The static electricity eliminating apparatus according to claim 8, in which the insulating layer is formed of a flat plate material, the first electrically conductive piece is disposed on one surface of the insulating layer, and the second electrically conductive piece is disposed on the other surface of the insulating layer.

14. The static electricity eliminating apparatus according to claim 13, in which a through-hole portion is formed through the insulating layer and the discharge means and the second discharge means are arranged in the through-hole portion.

15. The static electricity eliminating apparatus according to claim 8, in which the first electrically conductive piece is disposed on one surface of the insulating layer, the second electrically conductive piece is disposed on the other surface of the insulating layer, a through-hole portion is formed through the insulating layer, the discharge means and the second discharge means are disposed on the other surface side of the insulating layer, and one end of each of the discharge means and the second discharge means is electrically connected to the first electrically conductive piece through the through-hole portion.

16. A static electricity eliminating method with a static electricity eliminating apparatus comprising;

(A) a first electrically conductive piece and a second electrically conductive piece which are disposed so as to face each other through an insulating layer, and (B) a discharge means having one end electrically connected to the first electrically conductive piece and other end electrically connected to the second electrically conductive piece, said method comprising;

accumulating a charge, which is electrostatically induced in the first electrically conductive piece and the second electrically conductive piece due to a contact of a static-electricity-charged object with the first electrically conductive piece, between the first electrically conductive piece and the second electrically conductive piece by dielectric polarization, and then, discharging the charge with the discharge means in a state where the first electrically conductive piece and the second electrically conductive piece are not grounded.

* * * * *